US012709975B2

(12) United States Patent
Roskoss

(10) Patent No.: US 12,709,975 B2
(45) Date of Patent: Aug. 18, 2026

(54) SYSTEMS AND METHODS FOR AUDITABLE EMISSION MODELS

(71) Applicant: Sensia Netherlands B.V., Rotterdam (NL)

(72) Inventor: Alexander Harry Roskoss, York (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/825,792

(22) Filed: Sep. 5, 2024

(65) Prior Publication Data

US 2025/0075611 A1 Mar. 6, 2025

Related U.S. Application Data

(60) Provisional application No. 63/536,736, filed on Sep. 6, 2023.

(51) Int. Cl.
*E21B 47/00* (2012.01)
*E21B 49/00* (2006.01)

(52) U.S. Cl.
CPC ..... *E21B 47/00* (2013.01); *E21B 49/003* (2013.01)

(58) Field of Classification Search
CPC ..... E21B 47/00; E21B 49/003
See application file for complete search history.

(56) References Cited

U.S. PATENT DOCUMENTS

2021/0232935 A1* 7/2021 Meinrenken ..... G06N 5/02
2022/0065834 A1 3/2022 Gadot et al.
2022/0091026 A1* 3/2022 Scott ..... G01P 13/045
2022/0268749 A1 8/2022 Umay et al.
2022/0357234 A1 11/2022 Brandt et al.
2024/0031437 A1* 1/2024 Bennett ..... G06F 17/18
2024/0201639 A1* 6/2024 Copperthite ..... G05B 19/418

OTHER PUBLICATIONS

Goethel et al. ("[14]P7 Hydrocarbon Emission Control in Refineries and Product Distribution Systems in Germany." Paper presented at the 15th World Petroleum Congress, Beijing, China, Oct. 1997.) (Year: 1997).*
Skippon et al. ("Monitoring of Fugitive Hydrocarbon Emissions Using Open-Path Infra-Red Sensors." Paper presented at the SPE Health, Safety and Environment in Oil and Gas Exploration and Production Conference, The Hague, Netherlands, Nov. 1991. doi: https://doi.org/10.2118/23324-MS) (Year: 1991).*
European Search Report App. No. 24198657.9 dated Dec. 23, 2024.
Communication pursuant to Article 94(3) EPC on Patent Appl. No. 24198657.9 dated Jan. 14, 2026.

* cited by examiner

*Primary Examiner* — Christian T Bryant
(74) *Attorney, Agent, or Firm* — FOLEY & LARDNER LLP

(57) ABSTRACT

A method for display emission data associated with a site device includes obtaining sensor data from at least one sensor associated with the site device, determining, based on the sensor data, emission data corresponding to emissions associated with the site device over a period of time using one or more emission systems, generating display data corresponding to the emission data and traceable relationships between the emission data and the sensor data, and operating a display device to provide the display data to a user.

19 Claims, 9 Drawing Sheets

SYSTEMS AND METHODS FOR AUDITABLE EMISSION MODELS

CROSS-REFERENCE TO RELATED PATENT APPLICATION

This application claims the benefit of and priority to U.S. Provisional Patent Application No. 63/536,736, filed Sep. 6, 2023, the entire disclosure of which is incorporated by reference herein.

BACKGROUND

The present disclosure relates generally to systems that monitor and report emissions including but not limited to pollution, carbon, greenhouse gasses, and other emissions. In recent years, companies have started to report on their global energy usage (e.g., carbon consumption). For example, large businesses in the United Kingdom are required to disclose annual energy use and greenhouse gas emissions. Schemes for trading greenhouse gasses rely on the "cap and trade" principle, where a cap is set on the total amount of emissions a sector can emit. Measuring emissions is an important first step to managing the level of emissions and giving companies an understanding of what main emissions. Regulators may investigate the methods used by companies to measure the emissions. A hydrocarbon site such as a well site can produce emissions. One type of hydrocarbon site is a natural gas site that produces or transports natural gas. Such sites can produce significant carbon emissions associated with the drilling, pumping, transportation, and processing activities at the site.

SUMMARY OF THE INVENTION

One implementation of the present disclosure is a method for display emission data associated with a site device. The method includes obtaining sensor data from at least one sensor associated with the site device, determining, based on the sensor data, emission data corresponding to emissions associated with the site device over a period of time using one or more emission systems, generating display data corresponding to the emission data and traceable relationships between the emission data and the sensor data, and operating a display device to provide the display data to a user.

In some embodiments, the method also includes operating, based on the emission data, at least one controllable element associated with the site device. In some embodiments, the one or more emission systems determine the emission data by combining a plurality of emission rates associated with the site device over the period of time. In some embodiments, the display data includes an element indicating a relationship between the emission data and the sensor data based on methods of the one or more emission systems.

In some embodiments, the method also includes determining, based on the sensor data, emission uncertainty data corresponding to uncertainty of the emission data, generating uncertainty display data corresponding to the emission uncertainty data and traceable relationships between the emission uncertainty data and the sensor data, and operating the display device to provide the uncertainty display data to the user. In some embodiments, the emission uncertainty data is determined over a period of time using one or more emission uncertainty systems.

In some embodiments, the one or more emission uncertainty determine the emission uncertainty data by combining a plurality of emission uncertainty rates associated with a plurality of emission rates associated with the site device over the period of time. In some embodiments, the uncertainty display data includes an element indicating a relationship between the emission uncertainty data and the sensor data based on methods of the one or more emission uncertainty systems.

Another implementation of the present disclosure is a computing system configured to monitor and/or control one or more operations of a plurality of site device associated with a hydrocarbon site. The computing system includes a processor configured to obtain sensor data from at least one sensor associated with the hydrocarbon site, determine, based on the sensor data, combined emission data corresponding to emissions associated with the hydrocarbon site, generate display data corresponding to the combined emission data and traceable relationships between the combined emission data and the sensor data, and operate a display device to provide the display data to a user.

In some embodiments, the combined emission data is determined over a period of time using one or more emission systems. In some embodiments, the one or more emission systems determine the emission data by combining a plurality of emission rates associated with the site devices of the hydrocarbon site over the period of time.

In some embodiments, the display data includes a first element indicating a first relationship between a first portion of the emission data and a first of the site devices based on methods of the one or more emission systems and a second element indicating a second relationship between a second portion of the emission data and a second of the site devices based on the methods of the one or more emission systems. In some embodiments, the processor is also configured to determine, based on the sensor data, emission uncertainty data corresponding to the uncertainty of the emission data, generate uncertainty display data corresponding to the emission uncertainty data and traceable relationships between the emission uncertainty data and the sensor data, and operate the display device to provide the emission uncertainty data to the user.

In some embodiments, the uncertainty display data includes a first element indicating a first relationship between a first portion of the emission uncertainty data and a first portion of the sensor data and a second element indicating a second relationship between a second portion of the emission uncertainty data and a second portion of the sensor data. In some embodiments, the emission uncertainty data is determined over a period of time using one or more emission uncertainty systems.

In some embodiments, the uncertainty display data includes a first element indicating a first relationship between a first portion of the emission uncertainty data and a first of the site devices based on methods of the one or more emission uncertainty systems and a second element indicating a second relationship between a second portion of the emission uncertainty data and a second of the site devices based on the methods of the one or more emission uncertainty systems.

In some embodiments, the uncertainty display data includes a first element indicating a first relationship between a first portion of the emission uncertainty data and one of the site devices based on methods of the one or more emission uncertainty systems and a second element indicating a second relationship between a second portion of the emission uncertainty data and one of the sensors associated with the hydrocarbon site.

Yet another implementation of the present disclosure is a hydrocarbon system, according to some embodiments. The hydrocarbon system includes a first site device, a second site device, and a processor. The processor is configured to obtain sensor data from at least one sensor associated with at least one of the first site device or the second site device, determine, based on the sensor data, combined emission data corresponding to emissions associated with the first site device and the second site device, determine, based on the sensor data, emission uncertainty data corresponding to the uncertainty of the emission data, generate display data corresponding to the combined emission data and traceable relationships between the combined emission data and the sensor data, generate uncertainty display data corresponding to the emission uncertainty data and traceable relationships between the emission uncertainty data and the sensor data, and operate a display device to provide the display data and the uncertainty display data to a user.

In some embodiments, the display data includes a first element indicating a first relationship between the emission data and the sensor data and the uncertainty display data includes a second element indicating a second relationship between the emission uncertainty data and the sensor data. In some embodiments, the display data includes a first element indicating a first relationship between the emission data and the first site device and a second element indicating a second relationship between the emission data and the second site device and the uncertainty display data includes a third element indicating a third relationship between the emission uncertainty data and the first site device and a fourth element indicating a fourth relationship between the emission uncertainty data and the second site device.

In some embodiments, the emission data is determined over a period of time using one or more emission systems. In some embodiments, the emission uncertainty data is determined over the period of time using one or more emission uncertainty systems.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another.

Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

Embodiments of the present disclosure are generally directed towards improvements in methods for displaying emissions of an emission site. The method includes obtaining sensor data of the emission site from sensors of an RTU. The method also includes determining emissions of emission devices over a period of time using the sensor data, a set of inputs, and a method of an emission system. The method also includes determining combined emissions of the emission site over the period of time by combining the emissions of the emission devices over the period of time. The method also includes generating display data of the emissions of the emission site over the period of time, the emissions of the emission devices over the period of time, and a traceable relationship between the emissions over the period of time of the emission site and the sensor data, the set of inputs, and the methods utilized by the emission system. The method also includes operating a display device to provide the display data.

System Overview

Cloud-Based Computing System

Figure 1:
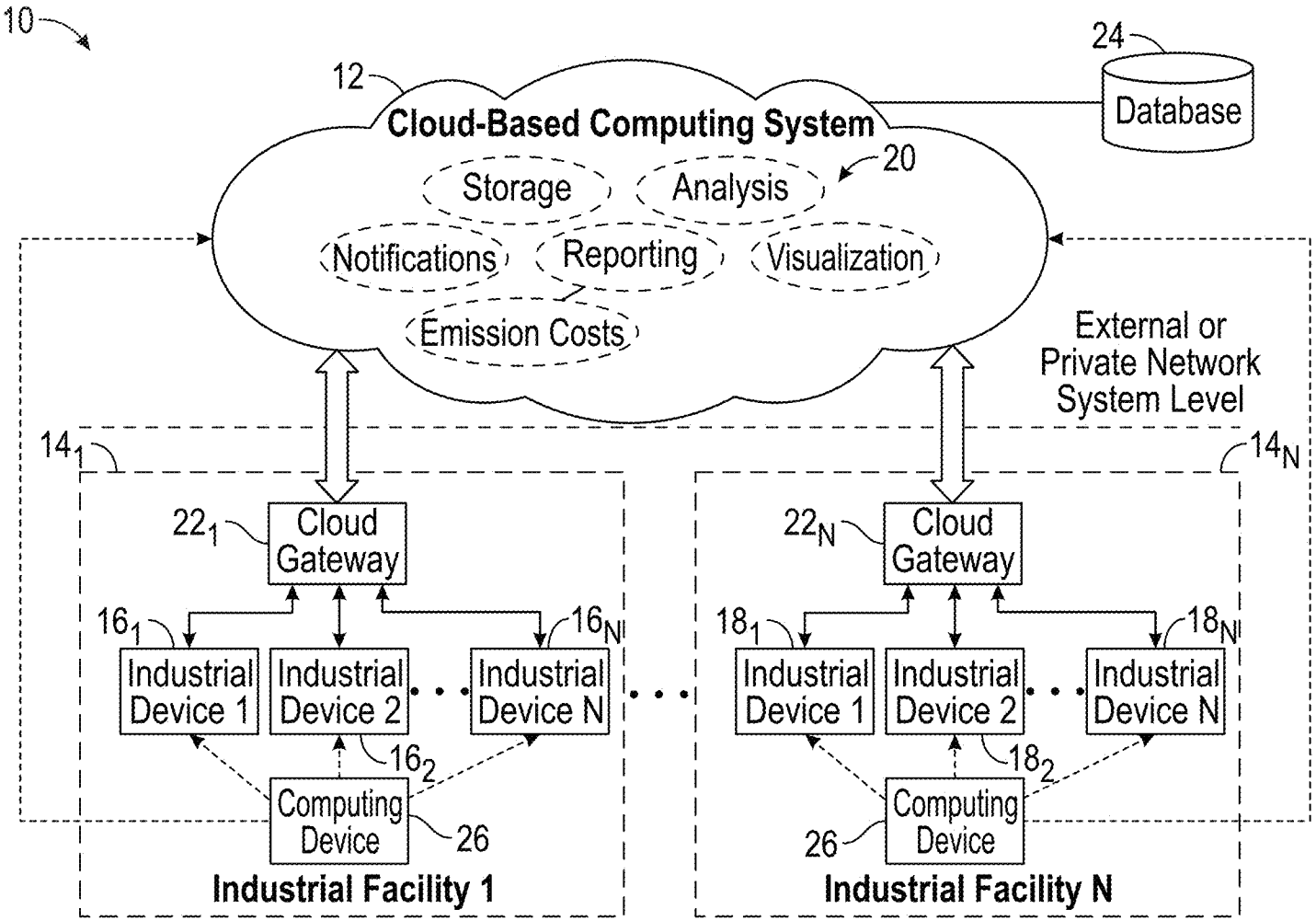
FIG. 1 illustrates a block diagram of a high-level overview of an industrial enterprise including a cloud-based computing system, according to some embodiments.

By way of introduction, FIG. 1 illustrates a high-level overview of an industrial enterprise such as a hydrocarbon site 10 that leverages a cloud-based computing system to improve the operations of various industrial devices (e.g., emission devices, devices, site devices, etc.). The enterprise or hydrocarbon site 10 may include one or more industrial facilities 14, each having a number of industrial devices 16 and 18 in use. The industrial devices 16 and 18 may make up one or more automation systems operating within the respective facilities 14. Exemplary automation systems may include, but are not limited to, batch control systems (e.g., mixing systems), continuous control systems (e.g., proportional-integral-derivative (PID) control systems), or discrete control systems. Industrial devices 16 and 18 may include devices, such as industrial controllers (e.g., programmable logic controllers or other types of programmable automation controllers), field devices such as sensors and meters, motor drives, operator interfaces (e.g., human-machine interfaces, industrial monitors, graphic terminals, message displays, etc.), industrial robots, barcode markers and readers, vision system devices (e.g., vision cameras), smart welders, or other such industrial devices.

In certain embodiments, the industrial devices 16 and 18 may communicatively couple to a computing device 26. The communication link between the industrial devices 16 and 18 and the computing device 26 may be a wired or a wireless connection, such as Wi-Fi®, Bluetooth®, and the like. Generally, the computing device 26 may be any type of processing device that may include communication abilities, processing abilities, and the like. For example, the computing device 26 may be a controller, such as a programmable logic controller (PLC), a programmable automation controller (PAC), or any other controller that may monitor, control, and operate the industrial device 16 and 18. The computing device 26 may be incorporated into any physical device (e.g., the industrial device 16 and 18) or may be implemented as a stand-alone computing device (e.g., general purpose computer), such as a desktop computer, a laptop computer, a tablet computer, a mobile computing device, or the like.

In addition to communicating with the industrial devices 16 and 18, the computing device 26 may establish a communication link (e.g., a wired communication link, a wireless communication link, etc.) with the cloud-based computing system 12. As such, the computing device 26 may have access to a number of cloud-based services provided by the cloud-based computing system 12, as will be described in more detail below. Generally, the computing device 26 may send and receive data to and from the cloud-based computing system 12 to assist a user of the industrial device 16 or 18 in the commissioning, operation, and/or maintenance of the industrial automation systems.

Exemplary automation systems can include one or more industrial controllers that facilitate monitoring and control of their respective processes and emissions. The controllers may exchange data with the field devices using native hardwired I/O or via a plant network such as Ethernet/IP, Data Highway Plus, ControlNet, DeviceNet, or the like. A given controller may receive any combination of digital or analog signals from the field devices indicating a current state of the devices, their associated processes, and uncertainty related thereto (e.g., temperature, position, part presence or absence, fluid level, etc.), and executes a user-defined control program that performs automated decision-making for the controlled processes based on the received signals. The controller may then output appropriate digital and/or analog control signaling to the field devices in accordance with the decisions made by the control program. These outputs may include device actuation signals, temperature or position control signals, operational commands to a machining or material handling robot, mixer control signals, motion control signals, and the like.

The control program may include any suitable type of code used to process input signals read into the controller and to control output signals generated by the controller, including but not limited to ladder logic, sequential function charts, function block diagrams, structured text, or other such platforms.

Although the industrial enterprise or hydrocarbon site 10 illustrated in FIG. 1 depicts the industrial devices 16 and 18 as residing in fixed-location industrial facilities 14, the industrial devices 16 and 18 may be part of a mobile control application, such as a system contained in a truck or other service vehicle. Additionally, although the industrial enterprise or hydrocarbon site 10 of FIG. 1 is described with respect to hydrocarbon production well sites, it should be noted that the systems and method for the industrial enterprise or hydrocarbon site 10 described herein may be applied to other emission sites (e.g., refineries, power plants, midstream processing sites, etc.).

In certain embodiments, the industrial devices 16 and 18 may be communicatively coupled to the cloud-based computing system 12 that may provide various applications, analysis operations, and access to data that may be unavailable to the industrial devices 16 and 18. For example, the industrial devices 16 and 18 may produce measurements and uncertainty values associated with the measurements and the cloud-based computing system 12 may analyze the measurements and/or the uncertainty values to determine information associated with the industrial devices 16 and 18. In some embodiments, the industrial devices 16 and 18 may interact with the cloud-based computing system 12, such that the industrial devices 16 and 18 may use various cloud-based services 20 to perform its respective operations more efficiently or effectively. The cloud-based computing system 12 may be any infrastructure that enables the cloud-based services 20 to be accessed and utilized by cloud-capable devices. In one embodiment, the cloud-based computing system 12 may include a number of computers that may be connected through a real-time communication network, such as the Internet, Ethernet/IP, ControlNet, or the like. By employing a number of computers, the cloud-based computing system 12 may distribute large-scale analysis operations over the number of computers that make up the cloud-based computing system 12.

Generally, the computers or computing devices provided by the cloud-based computing system 12 may be dedicated to performing various types of complex and time-consuming analysis that may include analyzing a large amount of data. In some embodiments, the computers or computing devices provided by the cloud-based computing system 12 provide emissions produced by emission devices (e.g., devices that produce emissions, etc.) for emission reporting and/or uncertainty values for the emissions produced by the emission devices. For example, the emission reporting can include graphical displays of compliance of daily emission totals of the emission devices and/or daily emission uncertainty relating to the daily emission totals relative to emission thresholds and/or uncertainty thresholds. In some embodiments, the emissions reporting includes tracking emissions emitted by flares relative to flare emission thresholds, gasses vented by the emission devices relative to gas venting thresholds, and/or emissions emitted by the emission devices relative to carbon credit thresholds along with uncertainty values for each. The emission reporting may include reports of mass carbon dioxide in emissions streams emitted by the emission devices and associated uncertainty. As a result of the cloud-based computing system 12 performing the complex and time-consuming analysis, the industrial devices 16 or 18 may continue their respective processing operations without performing additional processing or analysis operations that may involve analyzing large amounts of data collected from other data sources.

In certain embodiments, the cloud-based computing system 12 may be a public cloud accessible via the Internet by devices having Internet connectivity and appropriate authorizations to utilize the cloud-based services 20. In some scenarios, the cloud-based computing system 12 may be a platform-as-a-service (PaaS), and the cloud-based services 20 may reside and execute on the cloud-based computing system 12. In some embodiments, cloud-based computing system—is configured to provide, storage, notifications, reporting, visualization, and analysis of emissions and uncertainty.

Hydrocarbon Site

Figure 2:
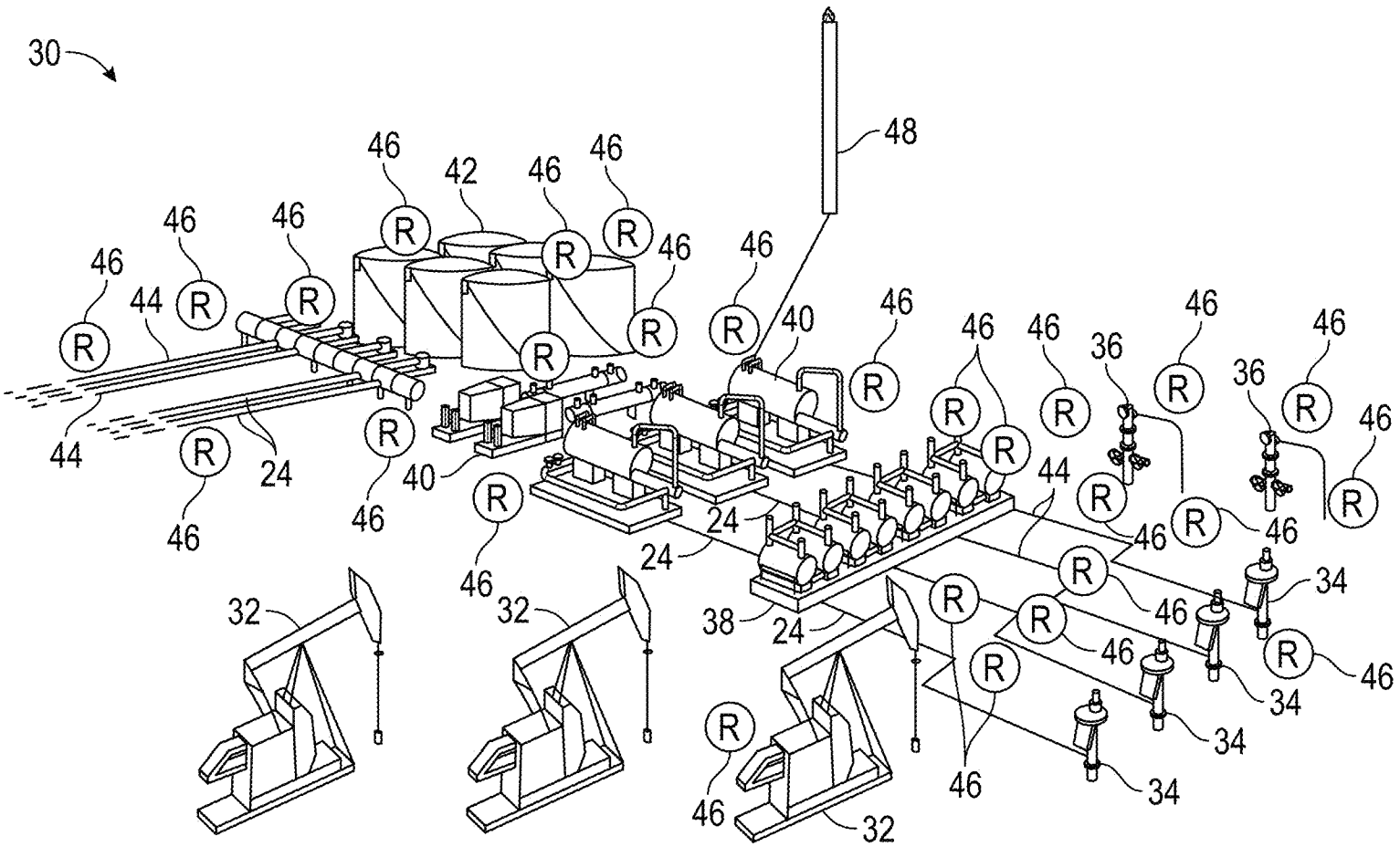
FIG. 2 illustrates a schematic diagram of an example hydrocarbon site that may produce and process hydrocarbons, according to some embodiments.

Referring now to FIG. 2, the hydrocarbon site 10 can be embodied as hydrocarbon site 30. Hydrocarbon site 30 may be an area in which hydrocarbons, such as crude oil and natural gas, are extracted from the ground, processed, and/or stored, in some embodiments. As such, the hydrocarbon site 30 may include a number of well sites (e.g., hydrocarbon well sites, oil well sites, etc.) and a number of well devices (e.g., pumps, jacks, wellheads, etc.) that may control the flow of hydrocarbons being extracted from the wells. In one embodiment, the well devices at the hydrocarbon site 30 may include any device equipped to monitor and/or control production of hydrocarbons at a well site. As such, the well devices may include pumpjacks 32, submersible pumps 34, well trees 36, and the like. After the hydrocarbons are extracted from the surface via the well devices, the extracted hydrocarbons may be distributed to other devices such as wellhead distribution manifolds 38, separators 40, storage tanks 42, flares 48 and the like. At the hydrocarbon site 30, the pumpjacks 32, submersible pumps 34, well trees 36, wellhead distribution manifolds 38, separators 40, storage tanks 42 and flares 48 may be connected together via a network of pipelines 44. As such, hydrocarbons extracted from a reservoir may be transported to various locations at the hydrocarbon site 30 via the network of pipelines 44. Conduits used on hydrocarbon site 30 may include flow meters for providing flow measurements and uncertainty values for the flow measurements. Additionally, although hydrocarbon site 30 of FIG. 2 is described with respect to wells and well devices, it should be noted that the systems and method for the hydrocarbon site 30 described herein may be applied to other emission devices of other emission sites (e.g., a compressor of a midstream processing site, a flare of a refinery, a vent of a power plant, etc.).

The pumpjack 32 may mechanically lift hydrocarbons (e.g., oil) out of a well when a bottom hole pressure of the well is not sufficient to extract the hydrocarbons to the surface. The submersible pump 34 may be an assembly that may be submerged in a hydrocarbon liquid that may be pumped (e.g., at a bottom of a well of one of the well sites, etc.). As such, the submersible pump 34 may include a hermetically sealed motor, such that liquids may not penetrate the seal into the motor. Further, the hermetically sealed motor may push hydrocarbons from underground areas or the reservoir to the surface.

The well trees 36 or Christmas trees may be an assembly of valves, spools, and fittings used for natural flowing wells. As such, the well trees 36 may be used for an oil well, gas well, water injection well, water disposal well, gas injection well, condensate well, and the like. The wellhead distribution manifolds 38 may collect the hydrocarbons that may have been extracted by the pumpjacks 32, the submersible pumps 34, and the well trees 36, such that the collected hydrocarbons may be routed to various hydrocarbon processing or storage areas in the hydrocarbon site 30.

The separator 40 may include a pressure vessel that may separate well fluids produced from oil and gas wells into separate gas and liquid components. For example, the separator 40 may separate hydrocarbons extracted by the pumpjacks 32, the submersible pumps 34, or the well trees 36 into oil components, gas components, and water components. After the hydrocarbons have been separated, each separated component may be stored in a particular storage tank 42. The hydrocarbons stored in the storage tanks 42 may be transported via the pipelines 44 to transport vehicles, refineries, and the like.

The flare 48 may include a flaring tower that is configured to burn off waste gas produced from oil and gas wells. For example, the flare 48 may burn off natural gas that is unable to be utilized by the hydrocarbon site 30 (e.g., natural gas that cannot be combusted to power the hydrocarbon site 30, natural gas that cannot be stored by the hydrocarbon site 30, etc.) to convert the natural gas into carbon dioxide so that it can be released into the atmosphere. In some embodiments, the flare 48 burns off the gas components separated by the separator 40. In some embodiments, the hydrocarbon site 30 may contain multiple of the flares 48 that are configured to burn different gases and/or different quantities of gases. The flare 48 may include controllable flare elements configured to control the operation of the flare 48. The well devices can also include venting mechanisms such as systems for venting natural gas sources.

The well devices may include monitoring systems that may be placed at various locations in the hydrocarbon site 30 to monitor or provide information related to certain aspects of the hydrocarbon site 30. As such, the monitoring system may be a flow meter, temperature sensor, pressure sensor, composition analyzer, density analyzer, controller, a remote terminal unit (RTU), any computing device that may include communication abilities, processing abilities, sensor, and the like. For discussion purposes, the monitoring system will be embodied as the RTU 46 throughout the present disclosure. However, it should be understood that the RTU 46 may be any component capable of monitoring and/or controlling various components at the hydrocarbon site 30.

The RTU 46 may include sensors or may be coupled to various sensors that may monitor various properties associated with a component at the hydrocarbon site 10. The RTU 46 may then analyze the various properties associated with the component and may control various operational parameters of the component. For example, the RTU 46 may measure a pressure or a differential pressure of a well or a component (e.g., storage tank 42) in the hydrocarbon site 30 and associated uncertainty. The RTU 46 may measure a temperature of contents stored inside a component in the hydrocarbon site 30, an amount of hydrocarbons being processed or extracted by components in the hydrocarbon site 30, and the like and associated uncertainty. The RTU 46 may measure a level or amount of hydrocarbons stored in a component, such as the storage tank 42. In certain embodiments, the RTU 46 may be iSens-GP Pressure Transmitter, iSens-DP Differential Pressure Transmitter, iSens-MV Multivariable Transmitter, iSens-T2 Temperature Transmitter, iSens-L Level Transmitter, or Isens-IO Flexible I/O Transmitter manufactured by vMonitor® of Houston, Texas.

In one embodiment, the RTU 46 may include a sensor that may measure pressure, temperature, fill level, flow rates, fluid composition, and the like and associated uncertainty. The RTU 46 may also include a transmitter, such as a radio wave transmitter, that may transmit data acquired by the sensor via an antenna or the like. The sensor in the RTU 46 may be wireless sensors that may be capable of receive and sending data signals between computing device 26 (e.g., between the RTUs 46). To power the sensors and the transmitters, the RTU 46 may include a battery or may be coupled to a continuous power supply. Since the RTU 46 may be installed in harsh outdoor and/or explosion-hazardous environments, the RTU 46 may be enclosed in an explosion-proof container that may meet certain standards established by the National Electrical Manufacturer Association (NEMA) and the like, such as a NEMA 4X container, a NEMA 7X container, and the like.

The RTU 46 may transmit data acquired by the sensor or data processed by a processor to other monitoring systems, a router device, a supervisory control, and data acquisition (SCADA) device, or the like. As such, the RTU 46 may enable users to monitor various properties of various components in the hydrocarbon site 30 without being physically located near the corresponding components.

In operation, the RTU 46 may receive real-time or near real-time data associated with a well device (e.g., the pumpjacks 32, the submersible pumps 34, the well trees 36, the wellhead distribution manifolds 38, the separators 40, the storage tanks 42 the flares 48, etc.). The data may include, for example, tubing head pressure, tubing head temperature, case head pressure, flowline pressure, wellhead pressure, wellhead temperature, and the like. In any case, the RTU 46 may analyze the real-time data with respect to static data that may be stored in a memory of the RTU 46. The static data may include a well depth, a tubing length, a tubing size, a choke size, a reservoir pressure, a bottom hole temperature, well test data, fluid properties of the hydrocarbons being extracted, and the like. The RTU 46 may also analyze the real-time data with respect to other data acquired by various types of instruments (e.g., water cut meter, multiphase meter) to determine an inflow performance relationship (IPR) curve, a desired operating point for the wellhead or hydrocarbon site 30, key performance indicators (KPIs) associated with the wellhead or hydrocarbon site 30, wellhead performance summary reports, and the like and associated uncertainty. Although the RTU 46 may be capable of performing the above-referenced analyses, the RTU 46 may not be capable of performing the analyses in a timely manner.

In some embodiments, the RTU 46 may establish a communication link with the cloud-based computing system 12 described above. As such, the cloud-based computing system 12 may use its larger processing capabilities to analyze data acquired by multiple computing devices 26 (e.g., RTUs). Moreover, the cloud-based computing system 12 may access historical data associated with the respective RTU 46, data associated with well devices associated with the respective RTU 46, data associated with the hydrocarbon site 30 associated with the respective RTU 46 and the like to further analyze the data acquired by the RTU 46.

Figure 3:
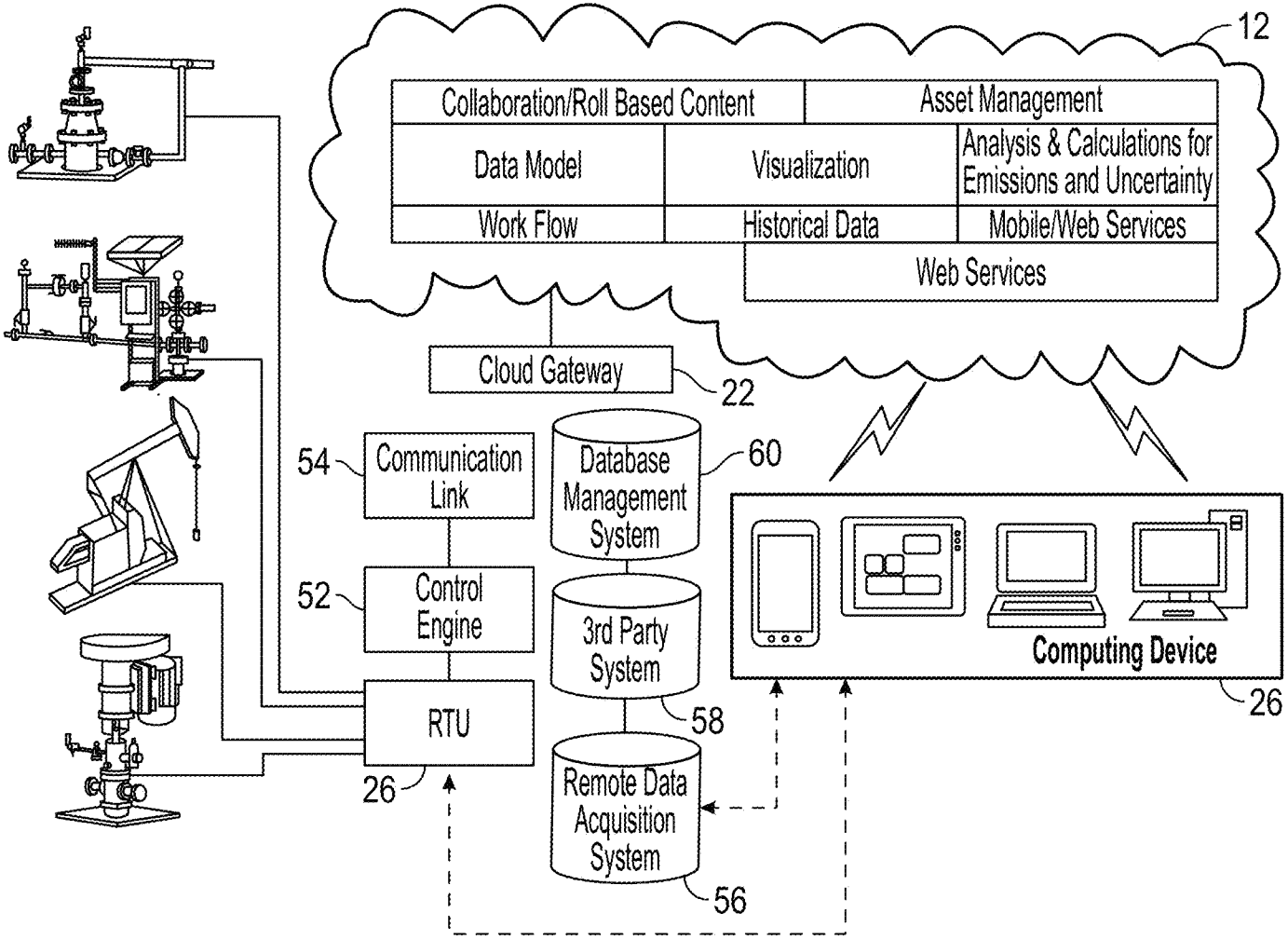
FIG. 3 illustrates an example overview of a cloud-based communication architecture for the example hydrocarbon site of FIG. 2, according to some embodiments.

Accordingly, in one embodiment, the RTU 46 may communicatively couple to the cloud-based computing system 12 via a cloud-based communication architecture or services 20 as shown in FIG. 3. Referring to FIG. 3, the RTU 46 may communicatively couple to a control engine 52 such as ControlLogix® or the like. The control engine 52 may, in tum, communicatively couple to a communication link 54 that may provide a protocol or specifications such as OPC Data Access that may enable the control engine 52 and the RTU 46 to continuously communicate its data to the cloud-based computing system 12 or computing device 26. The communication link 54 may be communicatively coupled to the cloud gateway 22, which may then provide the control engine 52 and the RTU 46 access to communicate with the cloud-based computing system 12. Although the RTU 46 is described as communicating with the cloud-based computing system 12 via the control engine 52 and the communication link 54, it should be noted that in some embodiments, the RTU 46 may communicate directly with the cloud gateway 22 like the industrial device 16 and 18 of FIG. 1 or may communicate directly with the cloud-based computing system 12.

In some embodiments, the computing device 26 (e.g., RTU) may communicatively couple to the control engine 52 or the communication link 54 via an Ethernet IP/Modbus network. As such, a polling engine may connect to the computing device 26 (e.g., RTU) via the Ethernet IP/Modbus network to poll the data acquired by the computing device 26 (e.g., RTU). The polling engine may then use an Ethernet network to connect to the cloud-based computing system 12.

As mentioned above, the RTU 46 may monitor and control various types of well devices and may send the data acquired by the respective well devices to the cloud-based computing system 12 according to the architecture described above. For example, as shown in FIG. 3, the RTU 46 may monitor and control an electrical submersible pump (ESP), a gas lift (GL), a rod pump controller (RPC), a progressive cavity pump (PCP), and the like. In the ESP, the RTU 46 may sense and control the wellhead and other operating variables of the ESP system. In the GL, the RTU 46 may adjust a gas lift injection flow to operator flow rate, compute real-time estimated gas-oil-water production, and the like. In the RPC, the RTU 46 may provide advance rod pump controlling operations for beam pump applications and the like. The RTU 46 may monitor both polish rod load and continuous walking beam position to develop dynamometer cards. In the PCP, the RTU 46 may provide local and remote monitoring of the wellhead and other PCP variable. Here, the RTU 46 may also perform basic analysis and adjust the pumping conditions of the PCP based on the received data from the PCP.

In addition to the RTU 46 and the control engine 52 being able to communicate with the cloud-based computing system 12, remote data acquisition systems 56, third party systems 58, and database management systems 60 may communicatively couple to the cloud gateway 22. The remote data acquisition systems 56 may acquire real-time data transmitted by various data sources such as the RTU 46 and other third party systems 58. The database management system 60 may be a relational database management system that stores and retrieves data as requested by various software applications. By way of example, the database management system 60 may be a SQL server, an ORACLE server, an SAP server, or the like.

As mentioned above, the computing device 26 may communicatively couple to the RTU 46 and the cloud-based computing system 12. As shown in FIG. 3, the computing device 26 may include a mobile device, a tablet device, a laptop, a general purpose computer, or the like. In certain embodiments, the computing device 26 may communicatively couple with the remote data acquisition systems 56, the third party system 58, and the database management system 60. By communicating with all of these types of devices, the computing device 26 may receive data and generate visualizations associated with each respective device, thereby providing the user of the computing device 26 a more efficient manner in which to view and analyze the data. Moreover, since the computing device 26 may receive data from the cloud-based computing system 12, the computing device 26 may receive visualizations and data related to various types of analyses (e.g., emissions calculations and associated uncertainty calculations) and cloud-based services 20 (e.g., emissions and associated uncertainty reporting) provided by the cloud-based computing system 12.

In some embodiments, the cloud-based computing system 12 may include applications related to collaboration or role based content, asset management, data models, visualizations, analysis & calculations, workflows, historical data, mobile web services, web services, and the like. The collaboration or role-based application may include facilitating collaboration between various users of the cloud-based computing system 12 to assist in the commission, operation, or maintenance of well devices at the hydrocarbon site 30. The asset management application may track the hardware and software maintenance of the well devices and the software used therein. The data model application may include algorithms that may simulate various types of data related to the production of hydrocarbons by a well device, the production of hydrocarbons at a hydrocarbon site, and the like based on various process parameter inputs received by the cloud-based computing system 12. The visualization application may generate various types of visualizations such as graphs, tables, data dashboards, and the like based on the data (e.g., emission and uncertainty data) received by the cloud-based computing system 12 and the data available to the cloud-based computing system 12 via the database 24 or the like.

The analysis and calculations applications may include software applications that may provide additional information regarding the data received by the cloud-based computing system 12. For example, the analysis & calculations applications may analyze flow rate data regarding the production of hydrocarbons by a particular well site to determine the amount of hydrocarbons, water, and sand (i.e., multiphase measurements) contained in the produced hydrocarbons. In another example, analysis and calculations applications may determine emission and uncertainty data for emissions as described below.

The workflow applications may be software applications that generate workflows or instructions for users of the well device or personnel at the hydrocarbon site 30 may use to perform their respective tasks. In one example, the cloud-based computing system 12 may generate a workflow regarding the monitoring of emissions, commissioning of a well device, troubleshooting an operation issue with a well device, or the like.

In certain embodiments, the workflow applications may determine the workflows based on historical data stored within the cloud-based computing system 12. That is, the historical data may include data related to previous items produced by any application within the cloud-based computing system 12 such as workflows, data analyses, reports, visualizations, and the like related emissions and uncertainty thereof. Moreover, the historical data may include raw data acquired by the RTU 46 or any other device and received by the cloud-based computing system 12. As such, the cloud-based computing system 12 may use the historical data to perform additional analyses on the received data, simulate, or predict how the operations of a well device may change, simulate how the production of hydrocarbons at a well site may change, emissions and emission uncertainty at the well site, and the like.

The cloud-based computing system 12 may provide mobile web services and web services that may enable the computing device 26, or any other device communicatively coupled to the cloud-based computing system 12, to access the Internet, Intranet, or any other network that may be available. Moreover, the cloud-based computing system 12 may use the web services to access information related to various analyses that it may be performing and the like.

Emissions Measurement

Figure 4:
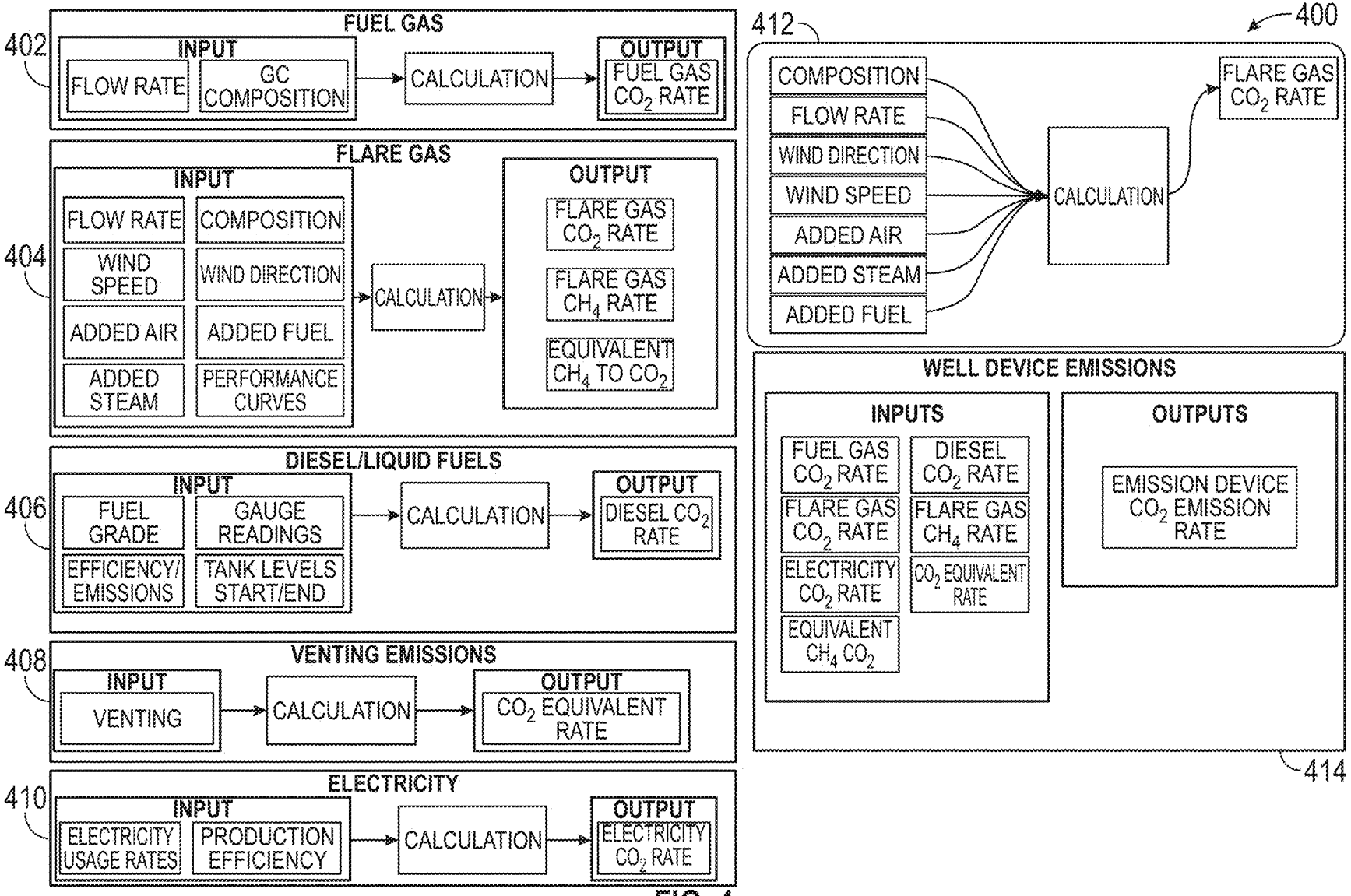
FIG. 4 illustrates a block diagram of a system for determining an emission rate associated with a device of an emission site or multiple emission sites, according to some embodiments.

With reference to FIG. 4, the system 12 can be configured to measure and track the live rate of emissions of the emission devices of the emission site as a system 400 (e.g., an emission rate system, an emission system, etc.). For example, the system 400 can provide emission data associated with the emissions of the emission devices of the emission site. The system 400 can be part of the system 12 and include sensors and computing components discussed above to perform the analysis and reporting described below. Advantageously, system 400 can allow for operators to determine the live rate of emissions emitted by each of the emission devices (e.g., pumps, compressors, separators, flares, etc.) of the emission site. Applying system 400 can also advantageously allow for operators to determine the portion of emissions of the emission site that are emitted from each of the emission devices using the same system. In some embodiments, system 400 can be configured to measure and track the live rate of emissions of the well devices of the well sites of hydrocarbon site 30. In other embodiments, system 400 can be configured to measure and track the live rate of emissions of the emission devices of other emission sites (e.g., refineries, power plants, etc.).

System 400 includes a fuel gas module 402, a flare gas module 404, a diesel fuel module 406, an emissions module 408, an electricity module 410, a flare emissions calculator 412, and an emission device emission calculator 414. When measuring and tracking the live rate of emissions of the emission devices using system 400, some modules may not contribute to the live rate of emissions of the emission device when the input to the module for the emission device is zero (e.g., a pump may not have a flare flow rate, a flare may not have a fuel gas flow rate, etc.). The fuel gas module 402 receives data representative of flow rate and/or gas chromatography (GC) composition and provides a fuel gas carbon dioxide emission rate associated with the use of fuel gas to power the emission device. For example, the fuel gas carbon dioxide emission rate may be a rate of carbon dioxide emissions generated by combusting the fuel gas used to power the emission device. In some embodiments, the fuel gas module 402 determines a portion of the fuel gas emissions that are emitted by a fuel gas combustor (e.g., a fuel gas generator, etc.) that are associated with powering the emission device. For example, if a fuel gas combustor is used to power a first emission device, a second emission device, and a third emission device, the fuel gas module 402 may determine a first portion of the fuel gas emissions associated with powering the first emission device, a second portion of the fuel gas emissions associated with powering the second emission device, and a third portion of the fuel gas emissions associated with powering the third emission device.

The flare gas module 404 receives data representative of flow rate, composition, added air quantity or rate, added steam quantity or rate, added fuel quantity or rate, and/or performance curves for a flaring operation associated with the emission device. In some embodiments, the flare gas module 404 also receives data representative of weather at a location of a flare associated with the flaring operation including but not limited to wind speed and wind direction. The flare gas module 404 provides a flare gas carbon dioxide rate, a flare gas methane rate, and/or a methane to carbon dioxide equivalent conversion measurement corresponding to the emissions associated with the emission device. These measurements can be made based upon readings from sensors such as multi-spectral infrared (IR) imagers or other analyzers that measure relative concentrations of unburned hydrocarbons, product of combustion (i.e., carbon dioxide), and/or product of incomplete combustion represented by carbon monoxide (CO). For example, one of the sensors may be positioned to take readings of emissions from a flare that are associated with the emission device. In some embodiments, the flare gas module 404 determines portions of the flare gas emission rates that for a flaring operation that are associated with the emission device. For example, if the flare 48 is used to flare off gases associated with a first emission device and a second emission device, the flare gas module 404 may determine a first portion of the flare gas emissions that associated with the first emission device and a second portion of the flare gas emissions that are associated with the second emission device.

The diesel fuel module 406 receives data representative of fuel grade, gauge readings, fuel efficiency, fuel emissions, and/or tank start and stop levels and provides a diesel carbon dioxide emission rate associated with the use of diesel or other fuels to power (e.g., provide energy to, etc.) the emission device. For example, the diesel fuel module 406 may determine the diesel carbon dioxide emission rate associated with powering the emission device by determining an amount of diesel consumed to power the emission device over a period of time. In some embodiments, the diesel fuel module 406 determines a portion of the diesel emissions that are emitted by a diesel combustor (e.g., a diesel generator, etc.) that are associated with powering the emission device. For example, if a diesel combustor is used to power a first emission device and a second emission device, the diesel fuel module 406 may determine a first portion of the diesel emissions associated with powering the first emission device and a second portion of the diesel emissions associated with powering the second emission device.

The venting emissions module 408 receives data representative of venting parameters (e.g., a composition of gasses vented to the atmosphere, a flow rate of gasses vented to the atmosphere, a volume of gasses vented to the atmosphere, etc.) associated with the emission device and provides a carbon dioxide equivalent rate for the venting operation. For example, if a quantity of gas is vented because a pump cannot handle the quantity of gas, the quantity of the gas may be considered a venting parameter associated with the pump and the venting emission module 408 may provide an emission rate associated with the quantity of the gas represented by a carbon dioxide equivalent to the gas. The carbon dioxide equivalent may be based on standards indicating amounts of carbon dioxide emissions that are considered equivalent to amounts of other gas emissions. In some embodiments, the venting emissions module 408 determines a portion of the venting gas emissions that are emitted by a venting device (e.g., a pressure relief valve, etc.) that are vented due to the emission device. For example, if a venting device is used to vent gases that flow through a first emission device and a second emission device, the venting emissions module 408 may determine that a first portion of the venting gas emissions correspond to (e.g., are caused by, are vented because of, etc.) the first emission device and a second portion of the venting gas emissions correspond to the second emission device.

The electricity module 410 receives data representative of electricity usage rate and production efficiency (e.g., the carbon dioxide emissions required to produce a unit of electricity, etc.) associated with the emission device and provides an electricity carbon dioxide emission rate associated with the use of electricity to power the emission device. In some embodiments, the electricity is sourced from a supplier who provides the production efficiency to the electricity module 410.

The flare emissions calculator 412 receives the data received by the flare gas module 404 and provides the flare gas carbon dioxide measurement associated with the emission device. The flare emissions calculator 412 determines the flare gas carbon dioxide rate representing the rate of carbon dioxide emissions of the flaring operation that are associated with the emission device. The flare emissions calculator 412 can be part of the flare gas module 404.

The emission device emission calculator 414 receives the fuel gas carbon dioxide rate from fuel gas module 402, the flare gas carbon dioxide rate from flare gas module 404, the flare gas methane rate from the flare gas module 404, the methane to carbon dioxide equivalent conversion measurement from the flare gas module 404, and/or the carbon dioxide equivalent rate from the emissions module 408. The emission device emission calculator 414 determines an emission device carbon dioxide emission rate that is a representation of the various emission rates generated by the modules of the system 400. For example, the emission device carbon dioxide emission rate may be representative of the carbon dioxide emission rate associated with powering the emission device (e.g., based on the fuel gas emission rate, the diesel emission rate, and/or the electricity emission rate, etc.), venting resulting from operation of the emission device (e.g., based on the venting emission rate, etc.), and/or flaring resulting from operation of the emission device (e.g., based on the flare gas emission rates, etc.). In some embodiments, the emission device emission calculator 414 converts any of the emission rates into equivalent carbon dioxide emission rates. For example, the emission device emission calculator 414 may utilize the methane to carbon dioxide equivalent conversion measurement from the flare gas module 404 to convert the flare gas methane emission rate into an equivalent carbon dioxide emission rate.

In some embodiments, the system 400 is configured to determine an emission site carbon dioxide emission rate associated with the emission site based on the emission device carbon dioxide emission rates associated with the emission devices of the emission site. For example, the system 400 may add together the various emission device carbon dioxide emission rates associated with the emission devices of the emission site to determine the emission site carbon dioxide emission rate associated with the emission site.

Uncertainty Measurement

Figure 5:
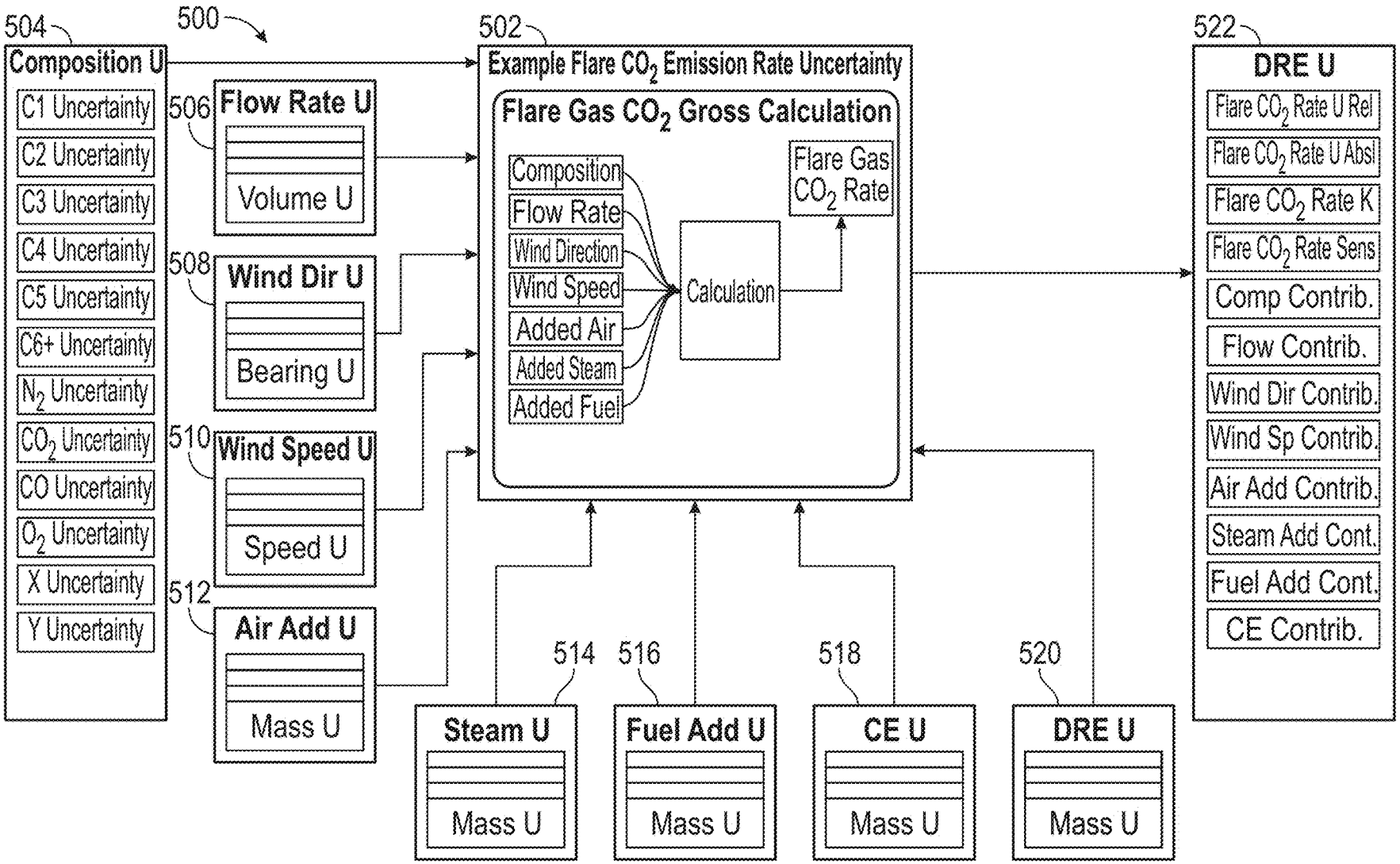
FIG. 5 illustrates a block diagram of a controller configured to perform an optimization for an emission site or multiple emission sites, according to some embodiments.

With reference to FIG. 5, system 12 can be configured to provide emission uncertainty data corresponding to the emission data associated with the emissions of the emission devices of the emission site as a system 500 (e.g., an emission uncertainty rate system, an emission uncertainty system, etc.). System 500 can be part of system 12 and include sensors and computing components discussed above to perform the analysis and reporting described below. System 500 can be used for any of the calculations or measurements described above with respect to FIG. 4, including but not limited to flare gas emissions, emission device emissions, etc. System 500 can be part of, include, or be in communications with system 400. System 500 can comply with international guidelines and standards on the expression of uncertainty in measurement when providing the emission rate uncertainty data associated with the emission devices of the emission site. In some embodiments, system 500 complies to JCGM 100:2008 GUM. Advantageously, system 500 can allow for operators to determine the live uncertainty rates corresponding to the emission rates associated with the emission devices of the emission site. Applying system 500 can also advantageously allow for operators to determine the portion of the live uncertainty rate that is associated with each of the emission devices and/or the sensors corresponding to the emission devices. In some embodiments, system 500 can be configured to provide emission rate uncertainty data associated with the well devices of the well sites of hydrocarbon site 30. In other embodiments, system 500 can be configured to provide emission rate uncertainty data associated with the emission devices of other emission sites (e.g., refineries, power plants, etc.).

System 500 includes a flare gas uncertainty calculator 502. The flare gas uncertainty calculator 502 can be part of or include or be in communication with flare emissions calculator 412. Flare gas uncertainty calculator 502 receives data representative of composition uncertainty from composition uncertainty module 504. The composition uncertainty module 504 can provide uncertainty data for each of a number of substances (e.g., gasses) including but not limited to carbon dioxide, water, nitrogen, carbon monoxide, oxygen, etc. The composition uncertainty values can be provided by composition sensors. Flare gas uncertainty calculator 502 receives data representative of flow rate uncertainty from flow rate uncertainty module 506. The flow rate uncertainty values can be provided by flow rate sensors, such as ultrasonic flow rate sensors or other meters.

Flare gas uncertainty calculator 502 also receives data representative of wind direction from module 508 and wind speed form module 510. Flare gas uncertainty calculator 502 also receives data representative of added air uncertainty at the site from module 512, added steam uncertainty from module 514, and added fuel uncertainty from module 516.

Flare gas uncertainty calculator 502 provides flare gas carbon dioxide relative uncertainty data, flare gas carbon dioxide absolute uncertainty data. Flare gas carbon dioxide relative uncertainty data is uncertainty data referenced to the amount of carbon dioxide emissions and can be given as a percentage. Flare gas uncertainty calculator 502 also provides data representative of flare carbon dioxide K, data representative of flare carbon dioxide Sen s, and data representative of composition uncertainty contribution, the flow uncertainty contribution, the wind direction uncertainty contribution, the wind speed uncertainty contribution, the added air uncertainty contribution, the added steam uncertainty contribution, and the added fuel uncertainty contribution. Flare carbon dioxide K is a coverage factor is representative of the number of standard deviations that the uncertainty represents. Flare carbon dioxide Sen s is a table of values that show the sensitivity of the output uncertainties to the input uncertainties. Each material in the composition can have its own uncertainty associated with its measurement.

System 500 can include an emission device uncertainty calculator for the data of emission device emission calculator 414 that accumulates the uncertainty for each output. For example, the uncertainty for each input and its contribution to emission device carbon dioxide emission rate provided by system 400 can be calculated to provide an uncertainty value for all factors used to determine the emission device carbon dioxide emission rate associated with the emission device. For example, the system 500 can provide an uncertainty value for the inputs utilized by the flare gas module 404 to determine the flare gas emission rates by taking into account the effect of the inputs on the flare gas emission rates. For example, if wind speed has a high uncertainty, but has far less effect to the flare carbon dioxide emission rate than flow rate uncertainty, the wind speed uncertainty will not contribute as much to the flare rate uncertainty as the flow rate uncertainty. Coefficients can be used to weight contributive uncertainty values in some embodiments.

In some embodiments, system 500 determines carbon dioxide emission rate uncertainty by adding the appropriate uncertainty contribution of each source of carbon dioxide. Each uncertainty value can be normalized according to the amount of emission rate from the source. For example, system 500 can use the following relationship to determine uncertainty for an emission device: DEmission device carbon dioxide emission rate uncertainty$=U_1E_1/E_{total}+U_2E_2/E_{total}+U_3E_3/E_{total}+U_4E_4/E_{total}+\ldots U_nE_n/E_{total}$, where n is any integer, $U_n$ is the relative uncertainty value for a source n, $E_n$ is the carbon dioxide emission rate for the source n, and $E_{total}=E_1+E_2+E_3+E_4\ldots+E_n$. In some embodiments, $U_1$ is uncertainty related to fuel gas carbon dioxide emission rate, $E_1$ is fuel gas carbon dioxide emission rate, $U_2$ is uncertainty related to flare gas carbon dioxide emission rate, $E_2$ is flare gas carbon dioxide emission rate, $U_3$ is uncertainty related to venting gas carbon dioxide emission rate, and $E_3$ is venting carbon dioxide emission rate.

In some embodiments, uncertainty values are accumulated across a large number of instruments (e.g., meters, sensors, etc.) and bundled for particular measurements. Uncertainty can be related to the time of last calibration, consistency with other instrument readings, consistency of power supply, the length of run time, etc. System 500 can include tables defining uncertainty levels and contributions by equipment under certain criteria. For example, uncertainty levels for equipment may increase or decrease depending on the magnitude of the measurement or environmental conditions.

Auditable Process

Figure 6:
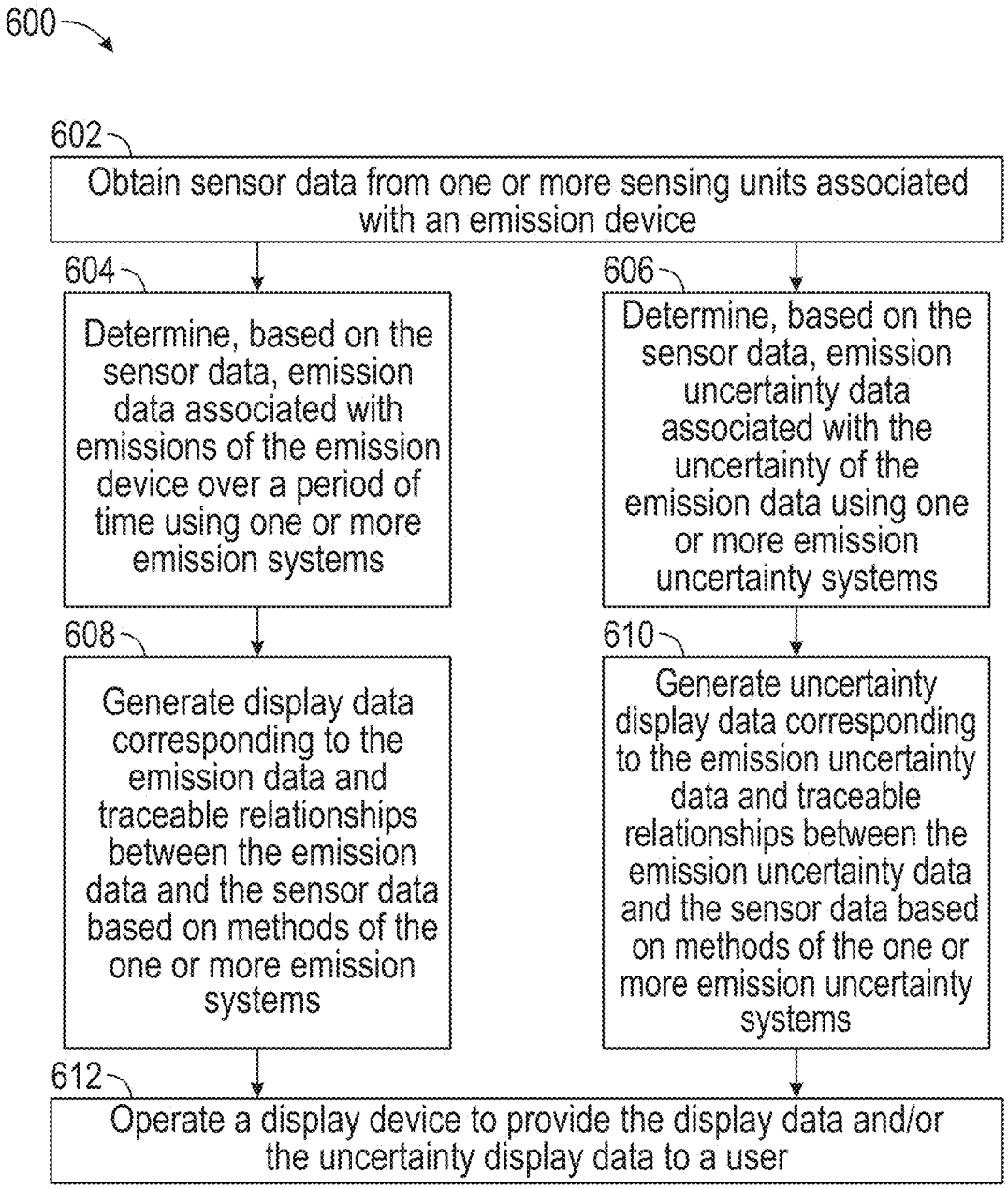
FIG. 6 illustrates a flow diagram of a process for determining combined emissions and/or combined emission uncertainty of the emission site or multiple emission sites, according to some embodiments.

Referring now to FIG. 6, a flow process diagram of a process 600 for displaying emission data and/or emission uncertainty data associated with emission uncertainty of an emission device is shown, according to some embodiments. Process 600 includes steps 602-612 and can be performed by the system 12 and/or the computing devices 26, according to some embodiments. In other embodiments, process 600 can be at least partially performed by the RTU 46. For example, step 602 and step 612 may be performed by the RTU 46 while steps 604-610 may be performed by the system 12 and/or the computing devices 26. In some embodiments, process 600 includes determining combined emission data associated with combined emissions of emission devices of an emission site and/or combined emission uncertainty data associated with combined emission uncertainty of emission devices of the emission site. In some embodiments, process 600 includes determining the combined emissions data and/or combined emission uncertainty data associated with the well sites of hydrocarbon site 30. In other embodiments, process 600 includes determining the combined emission data and/or the combined emission uncertainty data associated with other emission sites (e.g., refineries, power plants, etc.).

Process 600 includes obtaining sensor data from one or more sensing units associated with an emission device (step 602), according to some embodiments. In some embodiments, step 602 is performed by the RTU 46. For example, step 602 may include the RTU 46 obtaining the sensor data from one or more sensing units associated with one of the separators 40 of the hydrocarbon site 30. In other embodiments, the sensor data can be provided from the RTU 46 or multiple of the RTUs 46 to the control engine 52, to the computing devices 26, and/or to the system 12. The sensor data may include pressure, temperature, fill level, flow rates, and the like and the associated uncertainty with each.

Process 600 includes determining emission data associated with emissions of the emission device over a period of time (e.g., a reporting period, etc.) using one or more emission systems (step 604), according to some embodiments. In some embodiments, step 604 includes determining the emission data based on the sensor data received during step 602. In some embodiments, step 604 includes determining the emission data based on static data (e.g., a set of inputs, etc.) associated with the emission devices and/or the emission site (e.g., pump properties, motor properties, generator properties, flare properties, etc.). Step 604 may utilize the methods of the system 400 to determine the emission data associated with the emission of the emission device. For example, step 604 may include combining (e.g., summing, adding together, etc.) various emission rates associated with the emission device that are generated by the system 400 over the period of time to determine the emission data associated with the emissions of the emission device. In some embodiments, step 604 includes combining a series of averages of the emission rates associated with the emission device over the period of time multiplied by a time set associated with each of the averages to determine the emission data associated with the emissions of the emission device over the period of time. In other embodiments, step 604 determines the emission data associated with the emission device by combining the emission rates of the emission device over the period of time using a different method (e.g., utilizing rolling averages, utilizing the maximum rates over a time step, etc.).

In some embodiments, process 600 includes determining combined emission data associated with combined emissions of the emission devices of an emission site over the period of time based on the emission data determined for each of the emission devices during step 604. For example, process 600 may include determining the combined emission data associated with the combined emissions from one of the separators 40, one of the flares 48, and one of the pumpjacks 32 that belong to one of the hydrocarbon sites 30.

Process 600 includes determining emission uncertainty data associated with the uncertainty of the emission data using one or more emission uncertainty systems (step 606), according to some embodiments. In some embodiments, step 606 includes determining the emission uncertainty data based on the sensor data received during step 602. In some embodiments, step 606 includes determining the emission uncertainty data based on static data (e.g., a set of inputs, etc.) associated with the emission devices and/or the emission site (e.g., pump properties, motor properties, generator properties, flare properties, etc.). Step 604 may utilize the methods of the system 500 to determine the emission uncertainty data associated with the emission data determined in step 604. For example, step 606 may include combining various emission uncertainty rates that correspond to the emission rates associated with the emission device that are generated by the system 500 over the period of time to determine the emission uncertainty data that corresponds to the emission data associated with the emissions of the emission device. In some embodiments, step 606 includes combining a series of averages of the emission uncertainty rates associated with the emission data over the period of time multiplied by a time set associated with each of the averages to determine the emission uncertainty data associated with the emission data over the period of time. In other embodiments, step 606 determines the emission uncertainty data associated with the emission data by combining the emission uncertainty rates associated with the emission rates over the period of time using a different method (e.g., utilizing rolling averages, utilizing the maximum rates over a time step, etc.).

In some embodiments, process 600 includes determining combined emission uncertainty data that corresponds to the combined emission data associated with the combined emissions of the emission devices of the emission site over the period of time based on the emission uncertainty data determined for each of the emission devices determined during step 606. For example, process 600 may include determining the combined emission data that corresponds to the uncertainty associated with a first uncertainty of the emission data associate with the emissions of one of the separators 40, one of the flares 48, and one of the pumpjacks 32 that belong to one of the hydrocarbon sites 30.

Process 600 includes generating display data corresponding to the emission data and traceable relationships (e.g., a first traceable relationship, a derivative relationship, a dependent relationship, etc.) between the emission data and the sensor data based on the methods of the one or more emission systems (step 608), according to some embodiments. In various embodiments, the display data corresponds to the traceable relationship between the inputs and the methods (e.g., calculations, processes, etc.) utilized by the system 400 to determine the emission data. For example, the display data may include elements that indicate a first relationship between an age of the emission device and a first portion of the emissions, a second relationship between an amount of time since the emission device was serviced and a second portion of the emissions, a third relationship between weather over the period of time proximate the emission device and a third portion of the emissions, etc. As another example, the display data may include elements that indicate a first relationship between sensor data obtained from a first sensor associated with the emission device and a first portion of the emission data, a second relationship between sensor data obtained from a second sensor associated with the emission device and a second portion of the emission data, a third relationship between sensor data obtained from a third sensor associated with the emission device and a third portion of the emission data, etc. In some embodiments, step 608 includes generating the display data corresponding to traceable relationships between the emission data and the static data associated with the emission device. For example, the display data may include elements that indicate a first relationship between a first attribute (e.g., a first property, etc.) of the emission device and a first portion of the emission data, a second relationship between a second attribute of the emission device and a second portion of the emission data, etc. In some embodiments, step 608 includes generating display data that includes a live emission rate of the emissions of the emission device such that the live emission rate of the emissions may be provided to an operator of the emission device in real time.

In some embodiments, step 608 includes implementing a data schema to determine the traceable relationships between the emission data and the sensor data based on the methods of the one or more emission systems. For example, the system 400 may map relationships between the emission data and the sensor data based on the methods of the system 400 in a graphical format. The data schema implemented by the system 400 may include metadata associated with the emission device mapped into the data schema. For example, the metadata may include a size of a pump associated with the emission device, a bore size of a pipe associated with the emission device, a location of a sensor associated with the emission device, etc. Unstructured metadata associated with the emission device may not allow for easy determination of the relationships between the emission data and the sensor data based on the methods of the one or more emission systems, however, graphical data schemas can implement such identification of metadata information and allow control applications to determine the relationships between the emission data and the sensor data based on the methods of the one or more emission systems. As a result, when the system 400 receives the sensor data corresponding to the emissions associated with the emission device, the system 400 may implement the data schema that includes the metadata associated with the emission device to determine one or more relationships between the emission data and the sensor data.

In some embodiments, step 608 includes generating a data structure that depicts the traceable relationships between the emission data and the sensor data based on the methods of the one or more emission systems. The data structure may include nodes and edges, each node defined in terms of the sensor data or the emission data and the edges being the traceable relationships determined in step 608 based on the methods of the emission system 400. For example, a first node representing a first portion of the emission data may be added to the data structure and a second node representing a first portion of the sensor data may be added to the data structure. If the first portion of the sensor data is used by the methods of the emission system 400 to determine the first portion of the emission data, a relationship may be added as an edge to the data structure between the first node and the second node. The step 608 can be performed to map the sensor data and the emission data into graph data structure including multiple nodes and edges indicating the relationships between the multiple nodes. The data structure may be used to generate the display data corresponding to the traceable relationships between the emission data and the sensor data based on each of the edges included in the data structure. For example, the display data may include an element corresponding to each of the edges between the nodes of the data structure to indicate the relationships between the sensor data and the emission data that correspond to the edges between the nodes of the data structure. In some embodiments, a BRICK protocol, BRICK-like protocol adapted for well sites, or other framework for organizing metadata is used for storing data including relationships. The metadata can be associated with various elements associated with a well site, such as sensors, actuators, equipment, locations, power supplies, power consuming devices, pumps, etc. Consistent descriptions across different systems can be utilized making it easier to manage and integrate data. The framework can be ontology-based and provide a structure to define the relationships between different equipment in some embodiments. The framework allows system to communicate and share data more effectively and seamlessly.

In some embodiments, step 608 includes generating display data corresponding to the combined emission data and traceable relationships between the combined emission data and the sensor data based on the methods of the emission system 400. For example, the display data may include a first element indicating a first relationship between a first emission device and a first portion of the combined emissions of the emission site and a second element indicating a second relationship between a second emission device and a second portion of the combined emissions of the emission site such that the combined emissions of the emission site are traceable to (e.g., linked to, derived from, etc.) the sensor data obtained during step 602 and/or the static data associated with the emission devices based on the methods of system 400.

Process 600 includes generating uncertainty display data corresponding to the emission uncertainty data and traceable relationships between the emission uncertainty data and the sensor data and/or methods of the one or more emission uncertainty systems (step 610), according to some embodiments. In various embodiments, the uncertainty display data corresponds to the traceable relationship between the inputs and the methods utilized by the system 500 to determine the emission uncertainty data. For example, the uncertainty display data may include elements that indicate a first relationship between an age of the emission device and a first portion of the emission uncertainty, a second relationship between an amount of time since the emission device was calibrated and a second portion of the emission uncertainty, etc. As another example, the uncertainty display data may include elements that indicate a first relationship between sensor data obtained from a first sensor associated with the emission device and a first portion of the emission uncertainty data, a second relationship between sensor data obtained from a second device associated with the emission device and a second portion of the emission uncertainty data, etc. In some embodiments, step 610 includes generating the uncertainty display data corresponding to traceable relationships between the emission uncertainty data and the static data associated with the emission device. For example, the uncertainty display data may include elements that indicate a first relationship between a first attribute of the emission device and a first portion of the emission uncertainty data, a second relationship between a second attribute of the emission device and a second portion of the emission uncertainty data, etc.

In some embodiments, step 610 includes generate uncertainty display data that includes a live emission uncertainty rate associated with the emissions of the emission device such that the live emission uncertainty rate may be provided to an operator of the emission device in real time. Reporting emission uncertainty rates in a live dashboard may allow for operators to adjust operations to reduce uncertainty. For example, a high uncertainty with respect to flow rate may indicate that a flow meter should be recalibrated, replaced, or repaired. In another example, if flow uncertainty is dominant, the operator may reduce flow rate to rates where the uncertainty is decreased or recalibrate, replace, or repair the flow meter. Live emission uncertainty data for other analyzers or sensors (composition sensors) may also provide information for adjustments with respect to those values and equipment. In some embodiments, if certain added gasses have dominant uncertainty, the amount of those added gasses may be adjusted for the flare operation.

In some embodiments, step 610 includes implementing an uncertainty data schema to determine the traceable relationships between the emission uncertainty data and the sensor data based on the methods of the one or more emission uncertainty systems. For example, the system 500 may map relationships between the emission data and the sensor data based on the methods of the system 500 in a graphical format. The data schema implemented by the system 500 may include metadata associated with the emission device mapped into the data schema. For example, the metadata may include a time since a first sensor was last serviced, a comparison between sensor data generated by a first sensor and sensor data generated by a second sensor, etc. Unstructured metadata associated with the emission device may not allow for easy determination of the relationships between the emission uncertainty data and the sensor data based on the methods of the one or more emission uncertainty systems, however, graphical data schemas can implement such identification of metadata information and allow control applications to determine the relationships between the emission uncertainty data and the sensor data based on the methods of the one or more emission uncertainty systems. As a result, when the system 500 receives the sensor data corresponding to the emissions associated with the emission device, the system 500 may implement the data schema that includes the metadata associated with the emission device to extract one or more relationships between the emission uncertainty data and the sensor data.

In some embodiments, step 610 includes generating an uncertainty data structure that depicts the traceable relationships between the emission uncertainty data and the sensor data based on the methods of the one or more emission uncertainty systems. The uncertainty data structure may include nodes and edges, each node defined in terms of the sensor data or the emission uncertainty data and the edges being the traceable relationships determined in step 610 based on the methods of the emission uncertainty system 500. For example, a first node representing a first portion of the emission uncertainty data may be added to the uncertainty data structure and a second node representing a first portion of the sensor data may be added to the uncertainty data structure. If the first portion of the senor data is used by the methods of the emission uncertainty system 500 to determine the first portion of the emission uncertainty data, a relationship may be added as an edge to the uncertainty data structure between the first node and the second node. The step 610 can be performed to map the sensor data and the emission uncertainty data into an uncertainty graph data structure including multiple nodes and edges indicating the relationships between the multiple nodes. The uncertainty data structure may be used to generate the uncertainty display data corresponding to the traceable relationships between the emission uncertainty data and the sensor data based on each of the edges included in the uncertainty data structure. For example, the uncertainty display data may include an element corresponding to each of the edges between the nodes of the uncertainty data structure to indicate the relationships between the sensor data and the emission uncertainty data that correspond to the edges between the nodes of the uncertainty data structure.

In some embodiments, step 610 includes generating uncertainty display data corresponding to the combined emission uncertainty data and traceable relationships between the combined emission uncertainty data and the sensor data based on the methods of the emission uncertainty system 500. For example, the uncertainty display data may include a first element indicating a first relationship between a first emission device and a first portion of the combined uncertainty associated with the emissions of the emission site and a second element indicating a second relationship between a second emission device and a second portion of the combined uncertainty associated with the emissions of the emission site such that the combined emission uncertainty of the emission site is traceable to the sensor data obtained during step 602 and/or the static data associated with the emission devices based on the methods of system 500.

Process 600 includes operating a display device to provide the display data and/or the uncertainty display data to a user (step 612), according to some embodiments. In some embodiments, process 600 includes providing reports for viewing on any of computing devices 26 (FIG. 1). For example, the display data and/or the uncertainty display data may be aggregated into an emissions report which provides the emission data associated with the emissions of the emission device, the emission uncertainty data associated with the emission device, and/or the traceable relationships between (i) the emission data and the sensor data based on the methods utilized by the one or more emission systems to determine the emission data associated with the emissions of the emission device and/or (ii) the emission uncertainty data associated with the emission device and the sensor data based on the methods utilized by the one or more emission uncertainty systems to determine the emission uncertainty data associated with the emission device. In some embodiments, the display data and/or the uncertainty display data for each of the emission devices of one of the emission sites may be aggregated into the emission report.

The emissions report may advantageously allow for a regulator to audit (e.g., examine, review, verify, etc.) the emissions associated with the emission device or the emission site and/or the uncertainty corresponding to the emissions associated with the emission device or the emission site. For example, the emissions report may allow for the regulator to examine the relationships between the emission data and the emission device and/or the emission uncertainty data and the emission device to understand how the one or more emission systems and/or the one or more emission uncertainty systems determined the emission data and/or the emission uncertainty data based on the sensor data. The display data and/or uncertainty display data may reduce the amount of explanation (e.g., justification, proof, etc.) that the regulator requires to understand and/or approve of the emission data and/or the emission uncertainty data of the emission device while auditing the emission device. In some embodiments, the display data and/or the uncertainty display data may reduce the amount of explanation that the regulator requires to understand and/or approve the emission data and/or the emission uncertainty data of the emission site while auditing the emission site.

Figure 9:
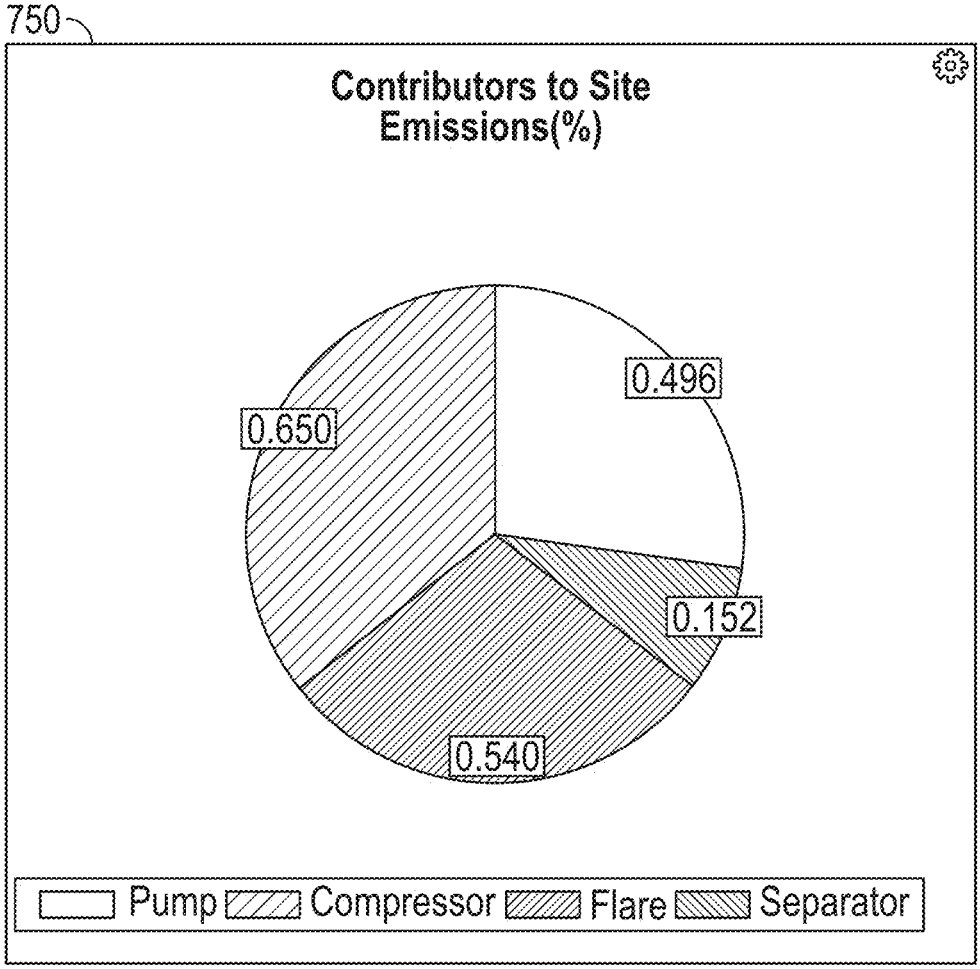
FIG. 9 illustrates a display showing charts for emissions provided by the systems illustrated in FIGS. 4 and 5.

With reference to FIG. 9, a pie chart 750 can be provided by process 600. The pie chart 750 reports relative emissions for emission devices such as a pump, a compressor, a flare, and a separator, according to some embodiments. In other embodiments, the pie chart 750 can be provided by process 600 to report relative emission uncertainty for emission devices such as the pump, the compressor, the flare, and the separator.

Substitute Data Process

Figure 7:
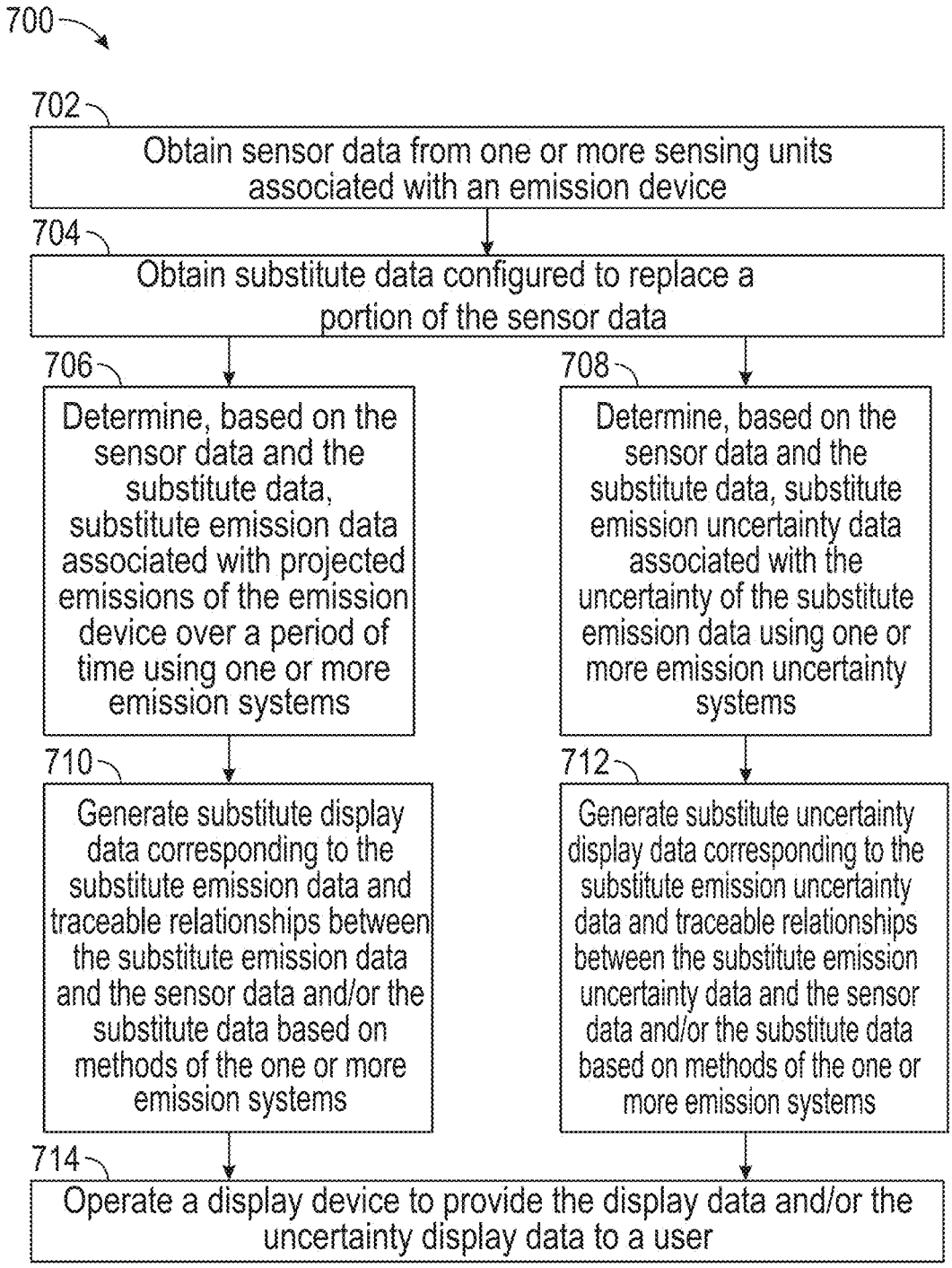
FIG. 7 illustrates a flow diagram of a process for determining combined replacement emissions and/or combined replacement emission uncertainty of the emission site or multiple emission sites, according to some embodiments.

Referring now to FIG. 7, a flow process diagram of a process 700 for displaying substitute emission data (e.g., replacement emission data, etc.) and/or substitute emission uncertainty data (e.g., replacement emission uncertainty data, etc.) associated with substitute emission uncertainty of an emission device is shown, according to some embodiments. Process 700 includes step 702-714 and can be performed by the system 12 and/or the computing devices 26, according to some embodiments. In other embodiments, process 700 can be at least partially performed by the RTU 46. For example, step 702 and step 714 may be performed by the RTU 46 while steps 704-712 may be performed by the system 12 and/or the computing devices 26. In some embodiments, process 700 includes determining combined replacement emission data associated with combined replacement emissions of emission devices of an emission site and/or combined replacement emission uncertainty data associated with combined replacement emission uncertainty of the emission devices of the emission site. In some embodiments, process 700 includes determining the combined replacement emission data and/or the combined replacement emission uncertainty data associated with the well sites of the hydrocarbon site 30. In other embodiments, process 700 includes determining the combined replacement emission data and/or the combined replacement emission uncertainty data associated with other emission sites (e.g., refineries, power plants, etc.).

Process 700 includes obtaining sensor data from one or more sensing units associated with an emission devices (step 702), according to some embodiments. In some embodiments, step 702 is performed by the RTU 46. For example, step 702 may include the RTU 46 obtaining the sensor data from one or more sensing units associated with one of the separators 40 of the hydrocarbon site 30. In other embodiments, the sensor data can be provided from the RTU 46 or multiple of the RTUs 46 to the control engine 52, to the computing devices 26, and/or to the system 12. The sensor data may include pressure, temperature, fill level, flow rates, and the like and the associated uncertainty with each.

Process 700 includes obtaining substitute data (e.g., replacement data, etc.) configured to replace a portion of the sensor data (step 704), according to some embodiments. The substitute data may be configured to replace the portion of the sensor data associated with a sensor corresponding to the emission device. For example, the substitute data may be configured to replace the portion of the sensor data that was collected by a sensor that was deemed inoperative (e.g., not accurate, unpowered, contributing significant uncertainty, etc.). In some embodiments, the substitute data is configured to replace a portion of the sensor data collected by a sensor during a past time frame such an operator can determine how replacing the portion of the sensor data with the substitute data would have affected the emission data and/or the emission uncertainty data during the past time frame. For example, the substitute data may correspond with increase a flow rate through a pump associated with the emission device such that the operator may determine how increasing the flow rate through the pump would have affected the emission data and/or the emission uncertainty data over the paste time frame such that the process 700 may be used to make future operational decisions regarding the emission device based on how the substitute data affects the emission data and/or the emission uncertainty data.

Process 700 includes determining substitute emission data associated with projected emissions of the emission device over a period of time using one or more emission systems (step 706), according to some embodiments. In some embodiments, step 706 includes determining the substitute emission data based on the sensor data received during step 702 and the substitute data received during step 704. For example, during step 706, the substitute data may replace the portion of the sensor data to form substituted sensor data and the substitute emission data may be determined using the substitute sensor data. In some embodiments, step 706 includes determining the substitute emission data based on the static data associated with the emission device and/or the emission site. Step 706 may utilize the methods of the system 400 to determine the substitute emission data associated with the projected emissions of the emission device. For example, step 706 may include combining various projected emission rates associated with the emission device that are generated by the system 400 over the period of time based on the substitute sensor data to determine the substitute emission data associated with the projected emissions of the emission device. In some embodiments, step 706 includes combining a series of averages of the substitute emission rates associated with the emission device over the period of time multiplied by a time set associated with each of the averages to determine the substitute emission data associated with the projected emissions of the emission device over the period of time. In other embodiments, step 706 determines the substitute emission data associated with the emission device by combining the substitute emission rates of the emission device over the period of time using a different method (e.g., utilizing rolling averages, utilizing the maximum rates over a time step, etc.).

In some embodiments, process 700 includes determining combined substitute emission data associated with the combined projected emissions of the emission devices of an emission site over the period of time based on the substitute emission data determined for each of the emission devices during step 706. For example, process 700 may include determining the combined substitute emission data associated with the combined substitute emissions from one of the separators 40, one of the flares 48, and one of the pumpjacks 32 that belong to one of the hydrocarbon sites 30.

Process 700 includes determining substitute emission uncertainty data associated with the uncertainty of the substitute emission data using one or more emission uncertainty systems (step 708), according to some embodiments. In some embodiments, step 708 includes determining the emission uncertainty data based on the sensor data received during step 702 and the substitute data received during step 704. For example, the sensor data may include sensor uncertainty related to the sensor data and the substitute data may include substitute uncertainty related to the substitute data. In some embodiments, step 708 includes determining the substitute emission uncertainty data based on the static data associated with the emission device and/or the emission site. Step 708 may utilize the methods of the system 500 to determine the substitute emission uncertainty data associated with the substitute emission data determined in step 706. For example, step 708 may include combining various substitute emission uncertainty rates that correspond to the substitute emission rates associated with the emission device that are generated by the system 50 over the period of time to determine the substitute emission uncertainty data that corresponds to the substitute emission data associated with the projected emissions of the emission device. In some embodiments, step 708 includes combining a series of averages of the substitute emission uncertainty rates associated with the substitute emission data over the period of time multiplied by a time set associated with each of the averages to determine the substitute emission uncertainty data associated with the substitute emission data over the period of time. In other embodiments, step 708 determines the substitute emission uncertainty data associated with the substitute emission data by combining the substitute emission uncertainty rates associated with the substitute emission rates over the period of time using a different method (e.g., utilizing rolling averages, utilizing the maximum rates over a time step, etc.).

In some embodiments, process 700 includes determining combined substitute emission uncertainty data that corresponds to the combined substitute emission data associated with the projected combined emissions of the emission devices of the emission site over the period of time based on the substitute emission uncertainty data determined for each of the emission devices determined during step 708. For example, process 700 may include determining the combined substitute emission uncertainty data that includes a first substitute uncertainty of the substitute emission data associated with the projected emissions of a first emission device and a second substitute uncertainty of the substitute emission data associated with the projected emissions of a second emission device.

Process 700 includes generating substitute display data corresponding to the substitute emission data and traceable relationships between the substitute emission data and the sensor data and/or the substitute data based on the methods of the one or more emission systems (step 610), according to some embodiments. In various embodiments, the substitute display data corresponds to the traceable relationship between the inputs and the methods utilized by the system 400 to determine the substitute emission data. For example, the substitute display data may include elements that indicate a first relationship between the substitute data and a first portion of the projected emissions and a second relationship between the sensor data and a second portion of the projected emissions. In some embodiments, the substitute display data corresponds to traceable relationships between the substitute emission data and the sensor data and traceable relationships between the substitute emission data and the substitute data. For example, the substitute display data may include elements that indicate portions of the projected emissions that correspond to the sensor data and portions of the projected emissions that correspond to the substitute data such that an operator of the emission device may visualize how replacing the portion of the sensor data with the substitute data affects the projected emissions. In some embodiments, step 710 includes generating substitute display data corresponding to the combined substitute emission data and traceable relationships between the combined substitute emission data for an emission site and the sensor data and/or the substitute data based on the methods of the emission system 400.

Process 700 includes generating substitute uncertainty display data corresponding to the substitute emission uncertainty data and traceable relationships between the emission uncertainty data and the sensor data, the substitute data, and/or methods of the one or more emission uncertainty systems (step 712), according to some embodiments. In various embodiments, the substitute uncertainty display data corresponds to the traceable relationships between the inputs and the methods utilized by the system 500 to determine the substitute emission uncertainty data. For example, the substitute uncertainty display data may include elements that indicate a first relationship between the sensor data and a first portion of the substitute emission uncertainty and a second relationship between the substitute data and a second portion of the substitute emission uncertainty. In some embodiments, the substitute uncertainty display data corresponds to traceable relationships between the substitute uncertainty emission data and the sensor data and traceable relationships between the substitute emission uncertainty data and the substitute data. For example, the substitute uncertainty display data may include elements that indicate portions of the substitute emission uncertainty that correspond to the sensor data and portions of the substitute emission uncertainty that correspond to the substitute data such that an operator of the emission device may visualize how replacing the portion of the sensor data with the substitute data affects the uncertainty associated with the projected emissions. In some embodiments, step 712 includes generating substitute uncertainty display data corresponding to the combined substitute emission uncertainty data and the traceable relationships between the combined substitute emission uncertainty data and the sensor data and/or the substitute data based on the methods of the system 500.

Process 700 includes operating a display device to provide the substitute display data and/or the substitute uncertainty display data to a user (step 714), according to some embodiments. In some embodiments, process 700 includes providing reports for viewing on any of computing devices 26 (FIG. 1). For example, the substitute display data and/or the substitute uncertainty display data may be aggregated into a substitute emissions report which provides the substitute emission data associated with the projected emissions of the emission device, the substitute emission uncertainty data associated with the emission device, and/or the traceable relationships between (i) the substitute emission data and the sensor data and/or the substitute data based on the methods utilized by the one or more emission systems to determine the substitute emission data associated with the projected emissions of the emission device and/or (ii) the substitute emission uncertainty data associated with the emission device and the sensor data and/or the substitute data based on the methods utilized by the one or more emission uncertainty systems to determine the substitute emission uncertainty data associated with the emission device. In some embodiments, the substitute display data and/or the substitute uncertainty display data for each of the emission devices of one of the emission sites may be aggregated into the emission report.

Simulated Process

Figure 8:
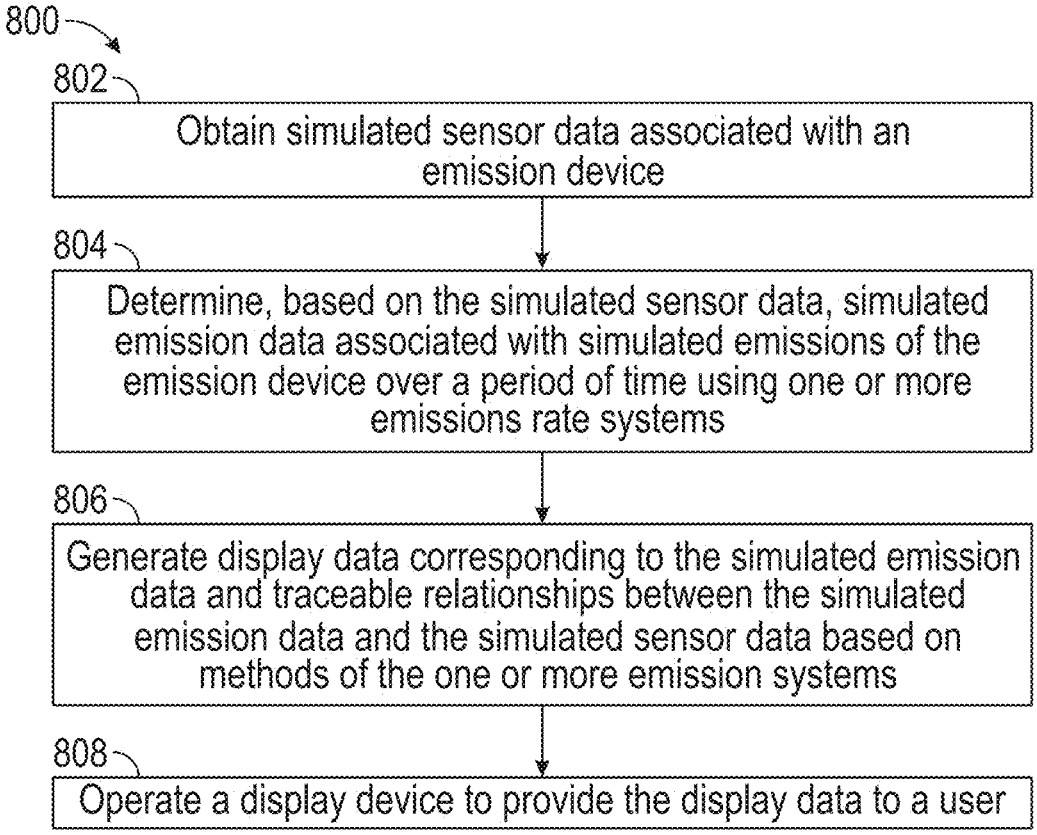
FIG. 8 illustrates a flow diagram of a process for determining simulated emissions of the emission site or multiple emission sites; according to some embodiments.

Referring now to FIG. 8, a flow process diagram of a process 800 for displaying simulated emission data is shown associated with simulated emission of an emission device is shown, according to some embodiments. Process 800 includes steps 802-808 and can be performed by the system 12 and/or the computing devices 26, according to some embodiments. In other embodiments, process 800 can at least partially be performed by the RTU 46. In some embodiments, process 800 includes determining combined simulated emission data associated with combined simulated emissions of the emission devices of the emission site. In some embodiments, process 800 incudes determining the combined simulated emission data associated with the well sites of the hydrocarbon site 30. In other embodiments, process 800 includes determining the simulated emission data associated with other emission sites (e.g., refineries, power plants, etc.).

Process 800 includes obtaining simulated data (e.g., simulated sensor data, etc.) associated with an emission device (step 802), according to some embodiments. In some embodiments, the simulated data may be historical data that corresponds to a known total amount of emissions (e.g., an established emission amount, a precalculated emission amount, etc.) For example, the historical data may have been previously provided by a regulator (e.g., a government agency, a third party inspector, an internal inspector, etc.) and may be used to verify the system 400. In some embodiments, the simulated data includes simulated uncertainty data. The simulated sensor data may include pressure, temperature, fill level, flow rates, and the like that are associated with the emission device.

Process 800 includes determining simulated emission data associated with simulated emissions of the emission device over a period of time using one or more emission rate systems (step 804), according to some embodiments. In some embodiments, step 804 includes determining the simulated emission data based on the simulated data received during step 802. In some embodiments, step 804 includes determining the simulated emission data based on the static data associated with the emission device and/or the emission site. Step 804 may utilize the methods of the system 400 to determine the simulated emission data associated with the simulated emissions of the emission device. For example, step 804 may include combining various simulated emission rates associated with the emission device that are generated by the system 400 over the period of time based on the simulated data to determine the simulated emission data associated with the simulated emissions of the emission device. In some embodiments, step 804 includes combining a series of averages of the simulated emission rates associated with the emission device over the period of time multiplied by a time set associated with each of the averages to determine the simulated emission data associated with the simulate emissions of the emission device over the period of time. In other embodiments, step 804 determines the simulated emission data associated with the emission device by combining the simulated emission data of the emission device over the period of time using a different method (e.g., utilizing rolling averages, utilizing the maximum rates over a time step, etc.). In some embodiments, step 804 includes determining simulated emission uncertainty data associated with the uncertainty of the simulated emission data using one or more emission uncertainty systems. For example, the simulated emission uncertainty data may be determined utilizing the methods of the system 500.

In some embodiments, process 800 includes determining combined simulated emission data associated with the combined simulated emissions of the emission devices of an emission site over the period of time based on the simulated emission data determined for each of the emission devices during step 804. For example, process 800 may include determining the combined simulated emission data associated with the combined simulated emissions from one of the separators 40, one of the flares 48, and one of the pumpjacks 32 that belong to one of the hydrocarbon sites 30. In some embodiments, process 800 includes determining combined simulated emission uncertainty data associated with the combined simulated emission uncertainty associated with the combined simulated emissions of the emission devices of the emission site over the period of time.

Process 800 includes generating simulated display data corresponding to the simulated emission data and traceable relationships between the simulated emission data and the simulated data based on the methods of the one or more emission systems (step 806), according to some embodiments. In various embodiments, the simulated display data corresponds to the traceable relationships between the inputs and the methods utilized by the system 400 to determine the simulated emission data. In some embodiments, step 806 includes generating simulated display data corresponding to the combined simulated emission data and traceable relationships between the combined simulated emission data for an emission site and the simulated data based on the methods of the emission system 400.

In some embodiments, process 800 includes generating simulated uncertainty display data corresponding to the simulated emission uncertainty data and traceable relationships between the simulated emission uncertainty data and the simulated data based on the methods of the one or more emission uncertainty systems. In various embodiments, the simulated uncertainty display data corresponds to the traceable relationships between the inputs and the methods utilized by the system 500 to determine the simulated emission uncertainty data.

Process 800 includes operating a display device to provide the simulated display data to a user (step 808), according to some embodiments. In some embodiments, process 800 includes providing reports for viewing on any of computing devices 26 (FIG. 1). For example, the simulated display data may be aggregated into a simulated emissions report which provides the simulated emission data associated with the simulated emissions of the emission device and/or the traceable relationships between the simulated emission data and the simulated data based on the methods utilized by the one or more emission systems to determine the simulated emission data associated with the simulated emissions of the emission device. In some embodiments, the simulated display data for each of the emission devices of one of the emission sites may be aggregated into the emission report. In some embodiments, process 800 includes operating the display device to provide the simulated uncertainty display data to the user.

Configuration of Exemplary Embodiments

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" and variations thereof, as used herein to describe various embodiments, are intended to indicate that such embodiments are possible examples, representations, or illustrations of possible embodiments (and such terms are not intended to connote that such embodiments are necessarily extraordinary or superlative examples).

The term "coupled" and variations thereof, as used herein, means the joining of two members directly or indirectly to one another. Such joining may be stationary (e.g., permanent or fixed) or moveable (e.g., removable or releasable). Such joining may be achieved with the two members coupled directly to each other, with the two members coupled to each other using a separate intervening member and any additional intermediate members coupled with one another, or with the two members coupled to each other using an intervening member that is integrally formed as a single unitary body with one of the two members. If "coupled" or variations thereof are modified by an additional term (e.g., directly coupled), the generic definition of "coupled" provided above is modified by the plain language meaning of the additional term (e.g., "directly coupled" means the joining of two members without any separate intervening member), resulting in a narrower definition than the generic definition of "coupled" provided above. Such coupling may be mechanical, electrical, or fluidic.

The term "or," as used herein, is used in its inclusive sense (and not in its exclusive sense) so that when used to connect a list of elements, the term "or" means one, some, or all of the elements in the list. Conjunctive language such as the phrase "at least one of X, Y, and Z," unless specifically stated otherwise, is understood to convey that an element may be either X, Y, Z; X and Y; X and Z; Y and Z; or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

References herein to the positions of elements (e.g., "top," "bottom," "above," "below") are merely used to describe the orientation of various elements in the FIGURES. It should be noted that the orientation of various elements may differ according to other exemplary embodiments, and that such variations are intended to be encompassed by the present disclosure.

The hardware and data processing components used to implement the various processes, operations, illustrative logics, logical blocks, modules and circuits described in connection with the embodiments disclosed herein may be implemented or performed with a general purpose single- or multi-chip processor, a digital signal processor (DSP), an application specific integrated circuit (ASIC), a field programmable gate array (FPGA), or other programmable logic device, discrete gate or transistor logic, discrete hardware components, or any combination thereof designed to perform the functions described herein. A general purpose processor may be a microprocessor or any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some embodiments, particular processes and methods may be performed by circuitry that is specific to a given function. The memory (e.g., memory, memory unit, storage device) may include one or more devices (e.g., RAM, ROM, Flash memory, hard disk storage) for storing data and/or computer code for completing or facilitating the various processes, layers and modules described in the present disclosure. The memory may be or include volatile memory or non-volatile memory, and may include database components, object code components, script components, or any other type of information structure for supporting the various activities and information structures described in the present disclosure. According to an exemplary embodiment, the memory is communicably connected to the processor via a processing circuit and includes computer code for executing (e.g., by the processing circuit or the processor) the one or more processes described herein.

The present disclosure contemplates methods, systems, and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. Combinations of the above are also included within the scope of machine-readable media. Machine-executable instructions include, for example, instructions and data which cause a general purpose computer, special purpose computer, or special purpose processing machines to perform a certain function or group of functions.

Although the figures and description may illustrate a specific order of method steps, the order of such steps may differ from what is depicted and described, unless specified differently above. Also, two or more steps may be performed concurrently or with partial concurrence, unless specified differently above. Such variation may depend, for example, on the software and hardware systems chosen and on designer choice. All such variations are within the scope of the disclosure. Likewise, software implementations of the described methods could be accomplished with standard programming techniques with rule-based logic and other logic to accomplish the various connection steps, processing steps, comparison steps, and decision steps.

It is important to note that the construction and arrangement of various systems and methods as shown in the various exemplary embodiments is illustrative only. Additionally, any element disclosed in one embodiment may be incorporated or utilized with any other embodiment disclosed herein. Although only one example of an element from one embodiment that can be incorporated or utilized in another embodiment has been described above, it should be appreciated that other elements of the various embodiments may be incorporated or utilized with any of the other embodiments disclosed herein

What is claimed is:

1. A method for auditing emissions associated with one or more emission sources, the method comprising;

obtaining, from at least one input associated with the one or more emission sources, operational data associated with operation of the one or more emission sources;

determining, based on the operational data, emission data corresponding to the emissions associated with the one or more emission sources over a period of time using one or more emission systems;

determining, based on the operational data, emission uncertainty data corresponding to uncertainty of the emission data using one or more emission uncertainty systems;

mapping, based on methods utilized by the one or more emission systems, a portion of the operational data input into the one or more emission systems to a portion of the emission data output by the one or more emission systems to determine a traceable relationship between the portion of the emission data and the portion of the operational data;

mapping, based on methods utilized by the one or more emission uncertainty systems, an uncertainty portion of the operational data input into the one or more emission uncertainty systems to the portion of the emission uncertainty data output by the one or more emission uncertainty systems to determine a traceable uncertainty relationship between the portion of the emission uncertainty data and the uncertainty portion of the operational data;

identifying, based on the traceable relationship, the traceable uncertainty relationship, and the portion of the operational data, at least one controllable element associated with the portion of the emission data; and operating the at least one controllable element by sending a control signal to the at least one controllable element, wherein the control signal causes the at least one controllable element to operate to decrease the emissions and the uncertainty of the emission data associated with the operation of the one or more emission sources.

2. The method of claim 1, further comprising:

determining, based on the operational data, a plurality of emission rates associated with the emissions of the one or more emission sources over a period of time utilizing the one or more emission systems;

wherein the one or more emission systems determine the emission data by combining the plurality of emission rates.

3. The method of claim 1, further comprising:

generating display data corresponding to the portion of the emission data, the portion of the operational data, and the traceable relationship; and operating a display device to provide the display data to a user;

wherein the display data includes an element corresponding to the traceable relationship, the element linking the portion of the emission data to the portion of the operational data.

4. The method of claim 1, further comprising:

generating uncertainty display data corresponding to the portion of the emission uncertainty data, the uncertainty portion of the operational data, and the traceable uncertainty relationship; and operating a display device to provide the uncertainty display data to a user.

5. The method of claim 4, further comprising:

determining, based on the operational data a plurality of emission rates associated with the one or more emission sources over a period of time utilizing the one or more emission systems; and determining, based on the operational data, a plurality of emission uncertainty rates associated with the plurality of emission rates;

wherein the one or more emission uncertainty systems determine the emission uncertainty data by combining the plurality of emission uncertainty rates.

6. The method of claim 4, wherein the uncertainty display data includes an element corresponding to the traceable uncertainty relationship, the element linking the portion of the emission uncertainty data to the uncertainty portion of the operational data.

7. The method of claim 1, wherein:

determining the emission data includes the one or more emission systems modeling the operational data to determine the emission data; and the mapping of the portion of the operational data to the portion of the emission data is based on the modeling of the operational data by the one or more emission systems.

8. The method of claim 1, wherein the mapping of the portion of the operational data to the portion of the emission data includes implementing a data schema that includes the operational data and the emission data to determine the traceable relationship.

9. A computing system configured to audit and/or control one or more operations of one or more emission sources associated with a hydrocarbon site, the computing system comprising:

at least one input associated with the hydrocarbon site; and a processor configured to:

obtain, from the at least one input, operational data associated with the one or more operations;

determine, based on the operational sensor data, combined emission data corresponding to emissions associated with the hydrocarbon site;

determine, based on the operational data, emission uncertainty data corresponding to uncertainty of the emission data using one or more emission uncertainty systems;

map, based on methods utilized to determine the combined emission data, a portion of the operational data to a portion of the combined emission data to determine a traceable relationship between the portion of the combined emission data and the portion of the operational data;

map, based on methods utilized by the one or more emission uncertainty systems, an uncertainty portion of the operational data input into the one or more emission uncertainty systems to the portion of the emission uncertainty data output by the one or more emission uncertainty systems to determine a traceable uncertainty relationship between the portion of the emission uncertainty data and the uncertainty portion of the operational data;

identify, based on the traceable relationship, the traceable uncertainty relationship, and the portion of the operational data, at least one controllable element associated with the portion of the emission data; and operate the at least one controllable element by sending a control signal to the at least one controllable element, wherein the control signal causes the at least one controllable element to operate to decrease the emissions and the uncertainty of the emission data associated with the operation of the one or more emission sources.

10. The computing system of claim 9, wherein the processor is further configured to:

determine, based on the operational data, a plurality of combined emission rates associated with the emissions of the hydrocarbon site over a period of time;

wherein the combined emission data is determined by combining the plurality of combined emission rates.

11. The computing system of claim 10, wherein the processor is further configured to:

generate display data corresponding to the portion of the combined emission data, the portion of the operational data, and the traceable relationship; and operate a display device to provide the display data to a user;

wherein the display data includes:

a first element corresponding to the first traceable relationship, the first element linking the first portion of the combined emission data to the first of the one or more emission sources; and a second element corresponding to the second traceable relationship, the second element linking the second portion of the combined emission data to the second of the one or more emission sources.

12. The computing system of claim 9, wherein the processor is further configured to:

generate display data corresponding to the portion of the combined emission data, the portion of the operational data, and the traceable relationship;

operate a display device to provide the display data to a user;

generate uncertainty display data corresponding to the portion of the emission uncertainty data, the uncertainty portion of the operational data, and the traceable uncertainty relationship; and operate the display device to provide the emission uncertainty data to the user.

13. The computing system of claim 9, wherein:

the processor is configured to determine the combined emission data by modeling the operational data using an emission model; and the processor is configured to map the portion of the operational data to the portion of the combined emission data based on the emission model.

14. The computing system of claim 9, wherein the processor is configured to map the portion of the operational data to the portion of the combined emission data by implementing a data schema that includes the operational data and the combined emission data to determine the traceable relationship.

15. A hydrocarbon system comprising:

a first emission source;

a second emission source; and a processor configured to:

obtain operational data from at least one input associated with at least one of the first emission source or the second emission source;

determine, based on the operational data, combined emission data corresponding to emissions associated with the first emission source and the second emission source;

map, based on methods utilized to determine the combined emission data, a first portion of the operational data to a portion of the combined emission data to determine a first traceable relationship between the portion of the combined emission data and the first portion of the operational data;

determine, based on the operational data, emission uncertainty data corresponding to uncertainty of the combined emission data;

map, based on uncertainty methods utilized to determine the emission uncertainty data, a second portion of the operational data to a portion of the emission uncertainty data to determine a second traceable relationship between the portion of the emission uncertainty data and the second portion of the operational data;

identifying, based on (i) the first traceable relationship and the first portion of the operational data and (ii) the second traceable relationship and the second portion of the operational data, at least one controllable element associated with at least one of the first portion of the operational data or the second portion of the operational data; and operate the at least one controllable element by sending a control signal to the at least one controllable element, wherein the control signal causes the at least one controllable element to operate to decrease the emissions associated with the first emission source and the second emission source and the uncertainty of the combined emission data.

16. The hydrocarbon system of claim 15, wherein the processor is further configured to:

generate display data corresponding to the portion of the combined emission data, the first portion of the operational data, and the first traceable relationship;

generate uncertainty display data corresponding to the portion of the emission uncertainty data, the second portion of the operational data, and the second traceable relationship; and operate a display device to provide the display data and the uncertainty display data to a user, wherein:

the display data includes a first element corresponding to the first traceable relationship, the first element linking the portion of the combined emission data to the first portion of the operational data; and the uncertainty display data includes a second element corresponding to the second traceable relationship, the second element linking the portion of the emission uncertainty data to the second portion of the operational data.

17. The hydrocarbon system of claim 15, wherein:

the processor is configured to determine the combined emission data by modeling the operational data using an emission model; and the processor is configured to map the portion of the operational data to the portion of the combined emission data based on the emission model.

18. The hydrocarbon system of claim 15, wherein the processor is configured to map the portion of the operational data to the portion of the combined emission data by implementing a data schema that includes the operational data and the combined emission data to determine the first traceable relationship.

19. The hydrocarbon system of claim 15, wherein:

the processor is configured to determine the emission uncertainty data by modeling the operational data using an emission uncertainty model; and the processor is configured to map the second portion of the operational data to the portion of the emission uncertainty data based on the emission uncertainty model.

* * * * *